US009740147B2

(12) United States Patent
Fujiwara et al.

(10) Patent No.: US 9,740,147 B2
(45) Date of Patent: Aug. 22, 2017

(54) SEPARATOR, FIXING DEVICE, AND IMAGE FORMING APPARATUS

(71) Applicants: Hitoshi Fujiwara, Osaka (JP); Tomoya Adachi, Kanagawa (JP); Tomohiko Fujii, Osaka (JP); Masahiro Samei, Osaka (JP); Yutaka Naitoh, Hyogo (JP); Yoshiharu Takahashi, Osaka (JP); Yasuharu Kawarasaki, Hyogo (JP); Kenta Kashiwagi, Osaka (JP); Kohta Sakaya, Kanagawa (JP)

(72) Inventors: Hitoshi Fujiwara, Osaka (JP); Tomoya Adachi, Kanagawa (JP); Tomohiko Fujii, Osaka (JP); Masahiro Samei, Osaka (JP); Yutaka Naitoh, Hyogo (JP); Yoshiharu Takahashi, Osaka (JP); Yasuharu Kawarasaki, Hyogo (JP); Kenta Kashiwagi, Osaka (JP); Kohta Sakaya, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 15/158,391

(22) Filed: May 18, 2016

(65) Prior Publication Data

US 2016/0378028 A1 Dec. 29, 2016

(30) Foreign Application Priority Data

Jun. 23, 2015 (JP) ..... 2015-125628

(51) Int. Cl.
*G03G 15/20* (2006.01)

(52) U.S. Cl.
CPC ..... *G03G 15/2028* (2013.01)

(58) Field of Classification Search
CPC ..... G03G 15/2028; G03G 15/2085
USPC ..... 399/323
See application file for complete search history.

(56) References Cited

U.S. PATENT DOCUMENTS

| | | | | |
|---|---|---|---|---|
| 2008/0056783 | A1 | 3/2008 | Yamamoto et al. | |
| 2008/0080909 | A1* | 4/2008 | Yamada | G03G 15/2028 399/323 |
| 2008/0193162 | A1 | 8/2008 | Yamazoe et al. | |
| 2009/0060572 | A1 | 3/2009 | Naitoh et al. | |
| 2009/0074440 | A1 | 3/2009 | Nanno et al. | |

(Continued)

FOREIGN PATENT DOCUMENTS

| | | |
|---|---|---|
| JP | 2011-065121 | 3/2011 |
| JP | 2013-015548 | 1/2013 |
| JP | 2014-174473 | 9/2014 |

OTHER PUBLICATIONS

U.S. Appl. No. 14/953,947, filed Nov. 30, 2015.

*Primary Examiner* — Sandra Brase
(74) *Attorney, Agent, or Firm* — Duft Bornsen & Fettig LLP

(57) ABSTRACT

A separator for separating a recording medium from a fixing rotator includes a separation body including a front end and a conveyance path side face. The front end is disposed in proximity to an outer circumferential surface of the fixing rotator. The conveyance path side face faces a conveyance path where the recording medium is conveyed. At least one rotary separation aid projects beyond the conveyance path side face of the separation body toward the conveyance path. The rotary separation aid is rotated by the recording medium as the recording medium comes into contact with the rotary separation aid.

17 Claims, 17 Drawing Sheets

(56) References Cited

U.S. PATENT DOCUMENTS

| | | | |
|---|---|---|---|
| 2009/0110449 | A1 | 4/2009 | Saito et al. |
| 2009/0129836 | A1 | 5/2009 | Sakaya et al. |
| 2010/0034548 | A1 | 2/2010 | Naitoh et al. |
| 2010/0086334 | A1 | 4/2010 | Sakaya |
| 2010/0232848 | A1 | 9/2010 | Naitoh |
| 2010/0239297 | A1 | 9/2010 | Sakaya et al. |
| 2011/0026944 | A1 | 2/2011 | Naitoh |
| 2011/0188874 | A1 | 8/2011 | Takahashi et al. |
| 2011/0299899 | A1 | 12/2011 | Ishigaya et al. |
| 2012/0020681 | A1 | 1/2012 | Naitoh et al. |
| 2012/0045241 | A1 | 2/2012 | Takahashi et al. |
| 2012/0093532 | A1 | 4/2012 | Ishigaya et al. |
| 2012/0093534 | A1 | 4/2012 | Waida et al. |
| 2012/0148287 | A1 | 6/2012 | Samei et al. |
| 2012/0148317 | A1 | 6/2012 | Samei et al. |
| 2012/0177422 | A1 | 7/2012 | Nanno et al. |
| 2012/0195652 | A1 | 8/2012 | Takahashi et al. |
| 2012/0243895 | A1 | 9/2012 | Samei et al. |
| 2012/0275834 | A1 | 11/2012 | Naitoh et al. |
| 2013/0004213 | A1 | 1/2013 | Takahashi |
| 2013/0004214 | A1 | 1/2013 | Sakaya et al. |
| 2013/0004217 | A1 | 1/2013 | Ikeda et al. |
| 2013/0004222 | A1 | 1/2013 | Sakaya et al. |
| 2013/0051876 | A1 | 2/2013 | Ishigaya et al. |
| 2013/0064586 | A1 | 3/2013 | Adachi et al. |
| 2013/0308990 | A1 | 11/2013 | Masahiro Samei et al. |
| 2014/0056625 | A1 | 2/2014 | Naitoh et al. |
| 2014/0072354 | A1 | 3/2014 | Toyoda et al. |
| 2014/0072357 | A1 | 3/2014 | Fukuhata et al. |
| 2014/0093288 | A1 | 4/2014 | Naitoh et al. |
| 2014/0099138 | A1 | 4/2014 | Ishigaya et al. |
| 2014/0099146 | A1 | 4/2014 | Fujii et al. |
| 2014/0112691 | A1 | 4/2014 | Nanno et al. |
| 2014/0133877 | A1 | 5/2014 | Samei et al. |
| 2014/0153982 | A1 | 6/2014 | Adachi et al. |
| 2014/0153983 | A1 | 6/2014 | Fujii et al. |
| 2014/0219672 | A1 | 8/2014 | Samei et al. |
| 2014/0219673 | A1 | 8/2014 | Yamamoto et al. |
| 2014/0219696 | A1 | 8/2014 | Fujimoto et al. |
| 2014/0227001 | A1 | 8/2014 | Kishi et al. |
| 2014/0270865 | A1 | 9/2014 | Yamaji et al. |
| 2014/0314459 | A1 | 10/2014 | Samei |
| 2015/0071688 | A1 | 3/2015 | Yamaguchi et al. |
| 2015/0078768 | A1 | 3/2015 | Yamaguchi et al. |
| 2015/0220028 | A1 | 8/2015 | Samei et al. |
| 2015/0220029 | A1 | 8/2015 | Samei et al. |
| 2015/0248091 | A1 | 9/2015 | Nanno et al. |
| 2015/0346662 | A1 | 12/2015 | Kawarasaki et al. |
| 2016/0041511 | A1 | 2/2016 | Fujii et al. |
| 2016/0098000 | A1 | 4/2016 | Furuichi et al. |

* cited by examiner

SEPARATOR, FIXING DEVICE, AND IMAGE FORMING APPARATUS

CROSS-REFERENCE TO RELATED APPLICATION

This patent application is based on and claims priority pursuant to 35 U.S.C. §119 to Japanese Patent Application No. 2015-125628, filed on Jun. 23, 2015, in the Japanese Patent Office, the entire disclosure of which is hereby incorporated by reference herein.

BACKGROUND

Technical Field

Exemplary aspects of the present disclosure relate to a separator, a fixing device, and an image forming apparatus, and more particularly, to a separator for separating a recording medium from a fixing rotator, a fixing device incorporating the separator, and an image forming apparatus incorporating the fixing device.

Description of the Background

Related-art image forming apparatuses, such as copiers, facsimile machines, printers, or multifunction printers having two or more of copying, printing, scanning, facsimile, plotter, and other functions, typically form an image on a recording medium according to image data. Thus, for example, a charger uniformly charges a surface of a photoconductor; an optical writer emits a light beam onto the charged surface of the photoconductor to form an electrostatic latent image on the photoconductor according to the image data; a developing device supplies toner to the electrostatic latent image formed on the photoconductor to render the electrostatic latent image visible as a toner image; the toner image is directly transferred from the photoconductor onto a recording medium or is indirectly transferred from the photoconductor onto a recording medium via an intermediate transfer belt; finally, a fixing device applies heat and pressure to the recording medium bearing the toner image to fix the toner image on the recording medium, thus forming the image on the recording medium.

Such fixing device may include a fixing rotator, such as a fixing roller, a fixing belt, and a fixing film, heated by a heater and an opposed rotator, such as a pressure roller and a pressure belt, pressed against the fixing rotator to form a fixing nip therebetween through which a recording medium bearing a toner image is conveyed. As the recording medium bearing the toner image is conveyed through the fixing nip, the fixing rotator and the opposed rotator apply heat and pressure to the recording medium, melting and fixing the toner image on the recording medium.

SUMMARY

This specification describes below an improved separator for separating a recording medium from a fixing rotator. In one exemplary embodiment, the separator includes a separation body including a front end and a conveyance path side face. The front end is disposed in proximity to an outer circumferential surface of the fixing rotator. The conveyance path side face faces a conveyance path where the recording medium is conveyed. At least one rotary separation aid projects beyond the conveyance path side face of the separation body toward the conveyance path. The rotary separation aid is rotated by the recording medium as the recording medium comes into contact with the rotary separation aid.

This specification further describes an improved fixing device. In one exemplary embodiment, the fixing device includes a fixing rotator rotatable in a predetermined direction of rotation and an opposed rotator to press against the fixing rotator to form a fixing nip between the fixing rotator and the opposed rotator, through which a recording medium bearing a toner image is conveyed. A heater heats the fixing rotator. A separator is disposed downstream from the fixing rotator in a recording medium conveyance direction to separate the recording medium from the fixing rotator. The separator includes a separation body including a front end and a conveyance path side face. The front end is disposed in proximity to an outer circumferential surface of the fixing rotator. The conveyance path side face faces a conveyance path where the recording medium is conveyed. At least one rotary separation aid projects beyond the conveyance path side face of the separation body toward the conveyance path. The rotary separation aid is rotated by the recording medium as the recording medium comes into contact with the rotary separation aid.

This specification further describes an improved image forming apparatus. In one exemplary embodiment, the image forming apparatus includes an image forming device to form a toner image and a fixing device, disposed downstream from the image forming device in a recording medium conveyance direction, to fix the toner image on a recording medium. The fixing device includes a fixing rotator rotatable in a predetermined direction of rotation and an opposed rotator to press against the fixing rotator to form a fixing nip between the fixing rotator and the opposed rotator, through which the recording medium bearing the toner image is conveyed. A heater heats the fixing rotator. A separator is disposed downstream from the fixing rotator in the recording medium conveyance direction to separate the recording medium from the fixing rotator. The separator includes a separation body including a front end and a conveyance path side face. The front end is disposed in proximity to an outer circumferential surface of the fixing rotator. The conveyance path side face faces a conveyance path where the recording medium is conveyed. At least one rotary separation aid projects beyond the conveyance path side face of the separation body toward the conveyance path. The rotary separation aid is rotated by the recording medium as the recording medium comes into contact with the rotary separation aid.

BRIEF DESCRIPTION OF THE DRAWINGS

A more complete appreciation of the disclosure and the many attendant advantages thereof will be readily obtained as the same becomes better understood by reference to the following detailed description when considered in connection with the accompanying drawings, wherein.

DETAILED DESCRIPTION OF THE DISCLOSURE

Figure 1:
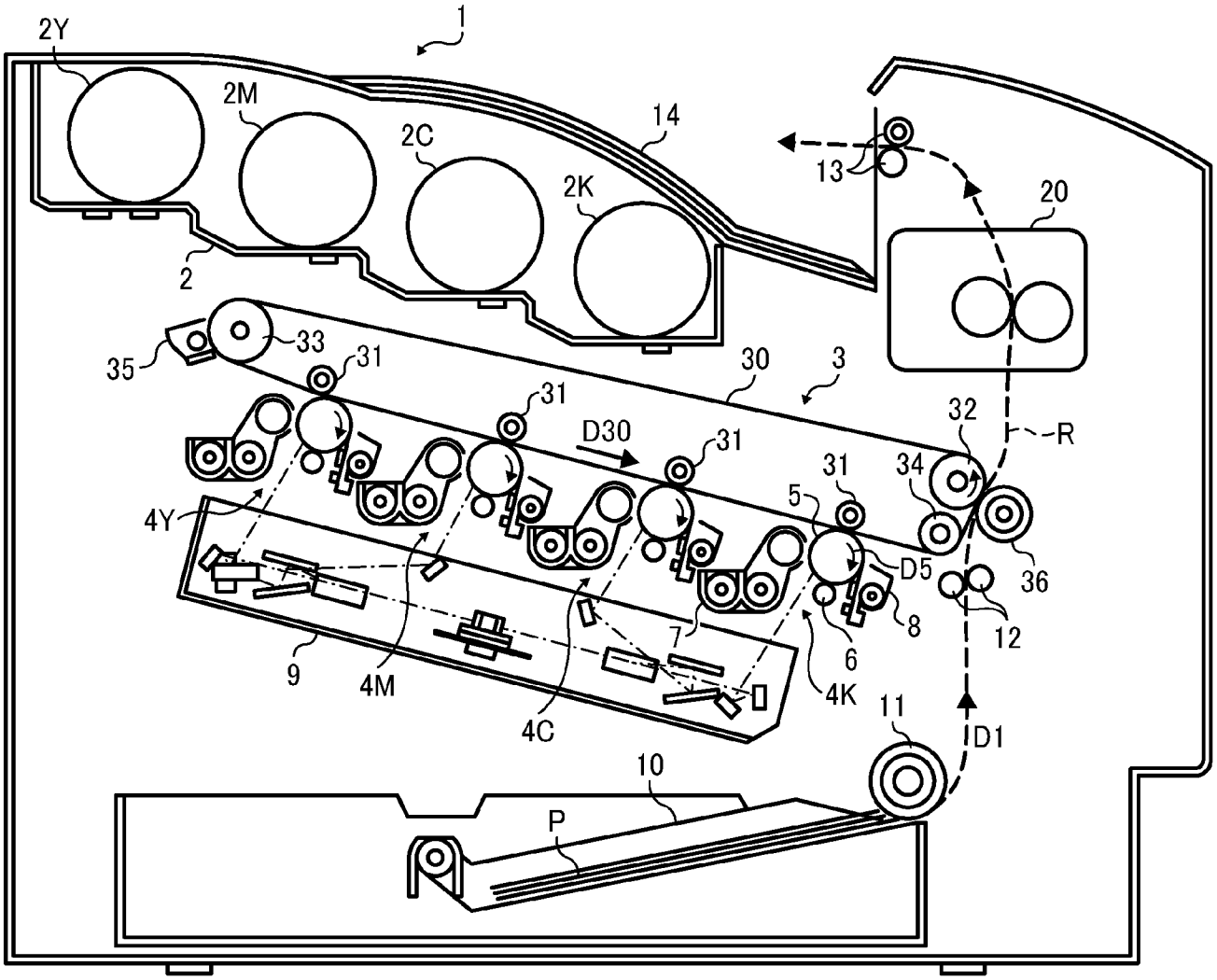
FIG. 1 is a schematic vertical cross-sectional view of an image forming apparatus according to an exemplary embodiment of the present disclosure.

In describing exemplary embodiments illustrated in the drawings, specific terminology is employed for the sake of clarity. However, the disclosure of this specification is not intended to be limited to the specific terminology so selected and it is to be understood that each specific element includes all technical equivalents that operate in a similar manner and achieve a similar result.

Referring now to the drawings, wherein like reference numerals designate identical or corresponding parts throughout the several views, in particular to FIG. 1, an image forming apparatus 1 according to an exemplary embodiment of the present disclosure is explained.

It is to be noted that, in the drawings for explaining exemplary embodiments of this disclosure, identical reference numerals are assigned, as long as discrimination is possible, to components such as members and component parts having an identical function or shape, thus omitting description thereof once it is provided.

FIG. 1 is a schematic vertical cross-sectional view of the image forming apparatus 1. The image forming apparatus 1 may be a copier, a facsimile machine, a printer, a multifunction peripheral or a multifunction printer (MFP) having at least one of copying, printing, scanning, facsimile, and plotter functions, or the like. According to this exemplary embodiment, the image forming apparatus 1 is a color printer that forms a color toner image on a recording medium by electrophotography. Alternatively, the image forming apparatus 1 may be a monochrome printer that forms a monochrome toner image on a recording medium.

Referring to FIG. 1, a description is provided of a construction of the image forming apparatus 1.

As illustrated in FIG. 1, the image forming apparatus 1 is a color laser printer including four image forming devices 4Y, 4M, 4C, and 4K situated in a center portion thereof. Although the image forming devices 4Y, 4M, 4C, and 4K contain developers (e.g., yellow, magenta, cyan, and black toners) in different colors, that is, yellow, magenta, cyan, and black corresponding to color separation components of a color image, respectively, they have an identical structure.

For example, each of the image forming devices 4Y, 4M, 4C, and 4K includes a drum-shaped photoconductor 5 serving as an image bearer or a latent image bearer that bears an electrostatic latent image and a resultant toner image; a charger 6 that charges an outer circumferential surface of the photoconductor 5; a developing device 7 that supplies toner to the electrostatic latent image formed on the outer circumferential surface of the photoconductor 5, thus visualizing the electrostatic latent image as a toner image; and a cleaner 8 that cleans the outer circumferential surface of the photoconductor 5. It is to be noted that, in FIG. 1, reference numerals are assigned to the photoconductor 5, the charger 6, the developing device 7, and the cleaner 8 of the image forming device 4K that forms a black toner image. However, reference numerals for the image forming devices 4Y, 4M, and 4C that form yellow, magenta, and cyan toner images, respectively, are omitted.

Below the image forming devices 4Y, 4M, 4C, and 4K is an exposure device 9 that exposes the outer circumferential surface of the respective photoconductors 5 with laser beams. For example, the exposure device 9, constructed of a light source, a polygon mirror, an f-θ lens, reflection mirrors, and the like, emits a laser beam onto the outer circumferential surface of the respective photoconductors 5 according to image data sent from an external device such as a client computer.

Above the image forming devices 4Y, 4M, 4C, and 4K is a transfer device 3. For example, the transfer device 3 includes an intermediate transfer belt 30 serving as an intermediate transferor, four primary transfer rollers 31 serving as primary transferors, a secondary transfer roller 36 serving as a secondary transferor, a secondary transfer backup roller 32, a cleaning backup roller 33, a tension roller 34, and a belt cleaner 35.

The intermediate transfer belt 30 is an endless belt stretched taut across the secondary transfer backup roller 32, the cleaning backup roller 33, and the tension roller 34. As a driver drives and rotates the secondary transfer backup roller 32 counterclockwise in FIG. 1, the secondary transfer backup roller 32 rotates the intermediate transfer belt 30 counterclockwise in FIG. 1 in a rotation direction D30 by friction therebetween.

The four primary transfer rollers 31 sandwich the intermediate transfer belt 30 together with the four photoconductors 5, forming four primary transfer nips between the intermediate transfer belt 30 and the photoconductors 5, respectively. The primary transfer rollers 31 are coupled to a power supply that applies a predetermined direct current (DC) voltage and/or a predetermined alternating current (AC) voltage thereto.

The secondary transfer roller 36 sandwiches the intermediate transfer belt 30 together with the secondary transfer backup roller 32, forming a secondary transfer nip between the secondary transfer roller 36 and the intermediate transfer belt 30. Similar to the primary transfer rollers 31, the secondary transfer roller 36 is coupled to the power supply that applies a predetermined direct current (DC) voltage and/or a predetermined alternating current (AC) voltage thereto.

A bottle holder 2 situated in an upper portion of the image forming apparatus 1 accommodates four toner bottles 2Y, 2M, 2C, and 2K detachably attached thereto to contain and supply fresh yellow, magenta, cyan, and black toners to the developing devices 7 of the image forming devices 4Y, 4M, 4C, and 4K, respectively. For example, the fresh yellow, magenta, cyan, and black toners are supplied from the toner bottles 2Y, 2M, 2C, and 2K to the developing devices 7 through toner supply tubes interposed between the toner bottles 2Y, 2M, 2C, and 2K and the developing devices 7, respectively.

In a lower portion of the image forming apparatus 1 are a paper tray 10 that loads a plurality of sheets P serving as recording media and a feed roller 11 that picks up and feeds a sheet P from the paper tray 10 toward the secondary transfer nip formed between the secondary transfer roller 36 and the intermediate transfer belt 30. The sheets P may be thick paper, postcards, envelopes, plain paper, thin paper, coated paper, art paper, tracing paper, overhead projector (OHP) transparencies, and the like. Optionally, a bypass tray that loads thick paper, postcards, envelopes, thin paper, coated paper, art paper, tracing paper, OHP transparencies, and the like may be attached to the image forming apparatus 1.

A conveyance path R extends from the feed roller 11 to an output roller pair 13 to convey the sheet P picked up from the paper tray 10 onto an outside of the image forming apparatus 1 through the secondary transfer nip. The conveyance path R is provided with a registration roller pair 12 located below the secondary transfer nip formed between the secondary transfer roller 36 and the intermediate transfer belt 30, that is, upstream from the secondary transfer nip in a sheet conveyance direction D1. The registration roller pair 12 serving as a timing roller pair conveys the sheet P conveyed from the feed roller 11 toward the secondary transfer nip at a proper time.

The conveyance path R is further provided with a fixing device 20 (e.g., a fuser or a fusing unit) located above the secondary transfer nip, that is, downstream from the secondary transfer nip in the sheet conveyance direction D1. The fixing device 20 fixes an unfixed toner image transferred from the intermediate transfer belt 30 onto the sheet P conveyed from the secondary transfer nip on the sheet P. The conveyance path R is further provided with the output roller pair 13 located above the fixing device 20, that is, downstream from the fixing device 20 in the sheet conveyance direction D1. The output roller pair 13 ejects the sheet P bearing the fixed toner image onto the outside of the image forming apparatus 1, that is, an output tray 14 disposed atop the image forming apparatus 1. The output tray 14 stocks the sheet P ejected by the output roller pair 13.

Referring to FIG. 1, a description is provided of an image forming operation performed by the image forming apparatus 1 having the construction described above to form a full color toner image on a sheet P.

As a print job starts, a driver drives and rotates the photoconductors 5 of the image forming devices 4Y, 4M, 4C, and 4K, respectively, clockwise in FIG. 1 in a rotation direction D5. The chargers 6 uniformly charge the outer circumferential surface of the respective photoconductors 5 at a predetermined polarity. The exposure device 9 emits laser beams onto the charged outer circumferential surface of the respective photoconductors 5 according to yellow, magenta, cyan, and black image data constituting color image data sent from the external device, respectively, thus forming electrostatic latent images thereon. The image data used to expose the respective photoconductors 5 is monochrome image data produced by decomposing a desired full color image into yellow, magenta, cyan, and black image data. The developing devices 7 supply yellow, magenta, cyan, and black toners to the electrostatic latent images formed on the photoconductors 5, visualizing the electrostatic latent images as yellow, magenta, cyan, and black toner images, respectively.

Simultaneously, as the print job starts, the secondary transfer backup roller 32 is driven and rotated counterclockwise in FIG. 1, rotating the intermediate transfer belt 30 in the rotation direction D30 by friction therebetween. The power supply applies a constant voltage or a constant current control voltage having a polarity opposite a polarity of the charged toner to the primary transfer rollers 31, creating a transfer electric field at the respective primary transfer nips formed between the photoconductors 5 and the primary transfer rollers 31.

When the yellow, magenta, cyan, and black toner images formed on the photoconductors 5 reach the primary transfer nips, respectively, in accordance with rotation of the photoconductors 5, the yellow, magenta, cyan, and black toner images are primarily transferred from the photoconductors 5 onto the intermediate transfer belt 30 by the transfer electric field created at the primary transfer nips such that the yellow, magenta, cyan, and black toner images are superimposed successively on a same position on the intermediate transfer belt 30. Thus, a full color toner image is formed on the outer circumferential surface of the intermediate transfer belt 30. After the primary transfer of the yellow, magenta, cyan, and black toner images from the photoconductors 5 onto the intermediate transfer belt 30, the cleaners 8 remove residual toner failed to be transferred onto the intermediate transfer belt 30 and therefore remaining on the photoconductors 5 therefrom, respectively.

On the other hand, the feed roller 11 disposed in the lower portion of the image forming apparatus 1 is driven and rotated to feed a sheet P from the paper tray 10 toward the registration roller pair 12 in the conveyance path R. The registration roller pair 12 halts the sheet P temporarily.

Thereafter, the registration roller pair 12 resumes rotation at a predetermined time to convey the sheet P to the secondary transfer nip at a time when the full color toner image formed on intermediate transfer belt 30 reaches the secondary transfer nip. The secondary transfer roller 36 is applied with a transfer voltage having a polarity opposite a polarity of the charged yellow, magenta, cyan, and black toners constituting the full color toner image formed on the intermediate transfer belt 30, thus creating a transfer electric field at the secondary transfer nip. Thus, the yellow, magenta, cyan, and black toner images constituting the full color toner image are secondarily transferred from the intermediate transfer belt 30 onto the sheet P collectively by the transfer electric field created at the secondary transfer nip. After the secondary transfer of the full color toner image from the intermediate transfer belt 30 onto the sheet P, the belt cleaner 35 removes residual toner failed to be transferred onto the sheet P and therefore remaining on the intermediate transfer belt 30 therefrom.

Thereafter, the sheet P bearing the full color toner image is conveyed to the fixing device 20 that fixes the full color toner image on the sheet P. Then, the sheet P bearing the fixed full color toner image is ejected by the output roller pair 13 onto the outside of the image forming apparatus 1, that is, the output tray 14 that stocks the sheet P.

The above describes the image forming operation of the image forming apparatus 1 to form the full color toner image on the sheet P. Alternatively, the image forming apparatus 1 may form a monochrome toner image by using any one of the four image forming devices 4Y, 4M, 4C, and 4K or may form a bicolor or tricolor toner image by using two or three of the image forming devices 4Y, 4M, 4C, and 4K.

Figure 2:
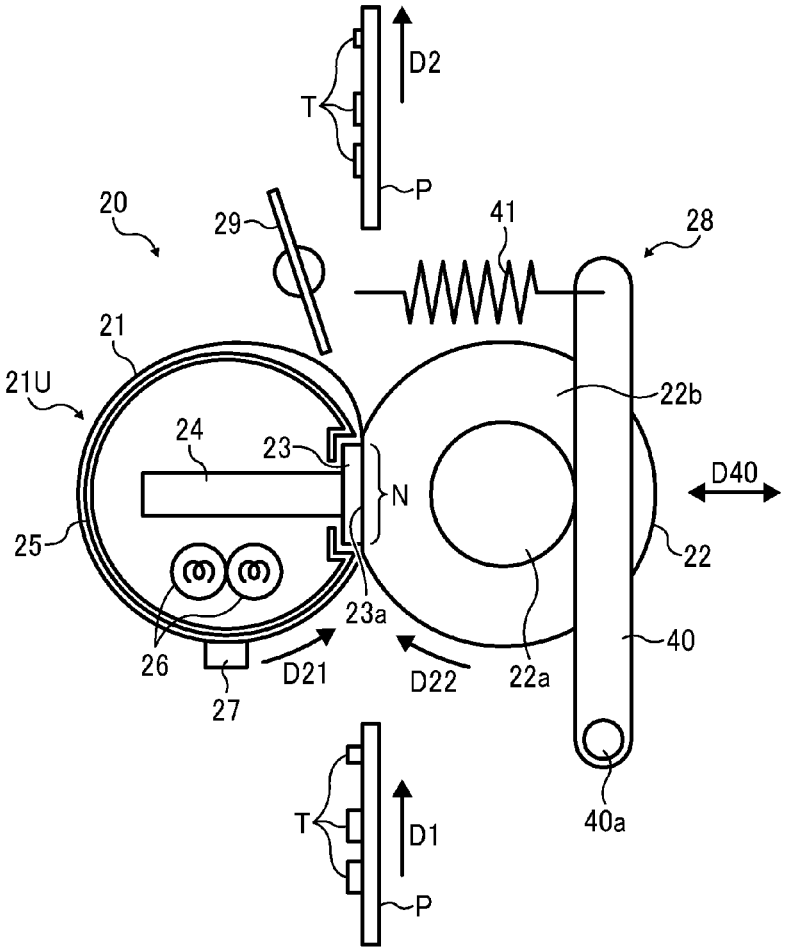
FIG. 2 is a schematic vertical cross-sectional view of a fixing device incorporated in the image forming apparatus illustrated in FIG. 1.

Referring to FIG. 2, a description is provided of a construction of the fixing device 20 incorporated in the image forming apparatus 1 having the construction described above.

FIG. 2 is a schematic vertical cross-sectional view of the fixing device 20. As illustrated in FIG. 2, the fixing device 20 includes a fixing belt 21, a pressure roller 22, a nip formation pad 23, a support 24, a thermal conductor 25, a heater 26, a temperature sensor 27, a pressurization assembly 28, and a separator 29. The fixing belt 21 formed into a loop serves as a fixing rotator rotatable in a rotation direction D21. The pressure roller 22 serves as an opposed rotator that is rotatable in a rotation direction D22 to come into contact with an outer circumferential surface of the fixing belt 21 to form a fixing nip N therebetween, through which a sheet P bearing a toner image T is conveyed. The nip formation pad 23 is disposed opposite the pressure roller 22 and in contact with an inner circumferential surface of the fixing belt 21. The support 24 supports the nip formation pad 23. The thermal conductor 25 is disposed opposite the inner circumferential surface of the fixing belt 21. The heater 26 serves as a heater or a heat source that heats the thermal conductor 25 by radiant heat or light, which in turn heats the fixing belt 21. The temperature sensor 27 serves as a temperature detector that detects the temperature of the outer circumferential surface of the fixing belt 21. The pressurization assembly 28 presses the pressure roller 22 against the nip formation pad 23 via the fixing belt 21. The separator 29 separates the sheet P having passed through the fixing nip N from the fixing belt 21. The fixing belt 21 and the components disposed inside the loop formed by the fixing belt 21, that is, the nip formation pad 23, the support 24, the thermal conductor 25, and the heater 26, may constitute a belt unit 21U separably coupled with the pressure roller 22.

A detailed description is now given of a construction of the fixing belt 21.

The fixing belt 21 is a thin, flexible endless belt. The thermal conductor 25 disposed opposite the inner circumferential surface of the fixing belt 21 rotatably supports the fixing belt 21. The fixing belt 21 is constructed of a base layer constituting the inner circumferential surface, an elastic layer coating the base layer, and a release layer coating the elastic layer, which produce a total thickness of the fixing belt 21 not greater than 1 mm. The base layer, having a thickness in a range of from 30 micrometers to 100 micrometers, is made of resin such as polyimide. Alternatively, the base layer may be made of metal such as nickel and stainless steel. The elastic layer, having a thickness in a range of from 100 micrometers to 300 micrometers, is made of rubber such as silicone rubber, silicone rubber foam, and fluoro rubber. The elastic layer absorbs slight surface asperities of the fixing belt 21 at the fixing nip N, facilitating even heat conduction from the fixing belt 21 to the toner image T on the sheet P and thereby suppressing formation of a faulty toner image on the sheet P. The release layer, having a thickness in a range of from 10 micrometers to 50 micrometers, is made of tetrafluoroethylene-perfluoroalkylvinylether copolymer (PFA), polytetrafluoroethylene (PTFE), polyimide (PI), polyether imide (PEI), polyether sulfide (PES), or the like. The release layer facilitates separation or peeling-off of toner of the toner image T on the sheet P from the fixing belt 21. A loop diameter of the fixing belt 21 is in a range of from 15 mm to 120 mm. According to this exemplary embodiment, the fixing belt 21 has a loop diameter of about 30 mm.

A detailed description is now given of a construction of the pressure roller 22.

The pressure roller 22, having a diameter in a range of from about 30 mm to about 40 mm, is constructed of a hollow cored bar 22*a* and an elastic layer 22*b* coating the cored bar 22*a*. The elastic layer 22*b* is made of silicone rubber foam, silicone rubber, fluoro rubber, or the like. Optionally, a thin release layer made of PFA, PTFE, or the like may coat an outer circumferential surface of the elastic layer 22*b*. The pressure roller 22 is pressed against the fixing belt 21 to form the desired fixing nip N between the pressure roller 22 and the fixing belt 21. The pressure roller 22 is rotatably mounted on and supported by a side plate of the fixing device 20 through a bearing at each lateral end of the pressure roller 22 in an axial direction thereof. The pressure roller 22 mounts a gear that engages a driving gear of a driver so that the pressure roller 22 is driven and rotated clockwise in FIG. 2 in the rotation direction D22. As the pressure roller 22 is driven and rotated in the rotation direction D22, the fixing belt 21 is driven and rotated counterclockwise in FIG. 2 in the rotation direction D21 by friction between the fixing belt 21 and the pressure roller 22.

A heater or a heat source such as a halogen heater may be situated inside the pressure roller 22. If the elastic layer 22*b* of the pressure roller 22 is made of sponge such as silicone rubber foam, the elastic layer 22*b* decreases pressure exerted to the fixing nip N, reducing bending of the nip formation pad 23. Additionally, the elastic layer 22*b* made of sponge enhances thermal insulation of the pressure roller 22, reducing heat conduction from the fixing belt 21 to the pressure roller 22 and thereby improving heating efficiency of the fixing belt 21. As illustrated in FIG. 2, the loop diameter of the fixing belt 21 is equivalent to the diameter of the pressure roller 22. Alternatively, the loop diameter of the fixing belt 21 may be smaller than the diameter of the pressure roller 22. In this case, a curvature of the fixing belt 21 is greater than a curvature of the pressure roller 22 at the fixing nip N, facilitating separation of the sheet P from the fixing belt 21 as the sheet P is ejected from the fixing nip N. Yet alternatively, the loop diameter of the fixing belt 21 may be greater than the diameter of the pressure roller 22. Regardless of a relation between the loop diameter of the fixing belt 21 and the diameter of the pressure roller 22, pressure from the pressure roller 22 is not exerted to the thermal conductor 25.

A detailed description is now given of a configuration of the nip formation pad 23.

The nip formation pad 23 is made of heat resistant resin such as liquid crystal polymer or the like. The nip formation pad 23 is a plate extending continuously in an axial direction of the fixing belt 21. An elastic member made of silicone rubber, fluoro rubber, or the like that is interposed between the nip formation pad 23 and the fixing belt 21 causes the outer circumferential surface of the fixing belt 21 to absorb slight surface asperities of the sheet P at the fixing nip N, facilitating even heat conduction from the fixing belt 21 to the toner image T on the sheet P and thereby suppressing formation of a faulty toner image on the sheet P. The nip formation pad 23 includes a planar contact face 23*a* that contacts the inner circumferential surface of the fixing belt 21. Alternatively, the contact face 23*a* of the nip formation pad 23 that contacts the fixing belt 21 may be contoured into a recess in cross-section to correspond to the curvature of the pressure roller 22, constructed of a plane and a recess contiguous to the plane, or contoured into arbitrary shapes.

A detailed description is now given of a configuration of the support 24.

The support 24 is secured to the side plate of the fixing device 20 at each lateral end of the support 24 in a longitudinal direction thereof parallel to the axial direction of the fixing belt 21 such that the support 24 is disposed inside the loop formed by the fixing belt 21. The support 24 has a length in the longitudinal direction thereof that is equivalent to a length of the nip formation pad 23 in a longitudinal direction thereof parallel to the axial direction of the fixing belt 21. The support 24 contacts an interior face of the nip formation pad 23 that is opposite the contact face 23*a* that contacts the fixing belt 21, thus supporting the nip formation pad 23. Accordingly, even if the nip formation pad 23 receives pressure from the pressure roller 22, the nip formation pad 23 is not bent by the pressure and therefore produces a uniform nip length of the fixing nip N in the sheet conveyance direction D1 throughout the entire width of the fixing belt 21 and the pressure roller 22 in the axial direction thereof. The support 24 is made of metal having an increased mechanical strength, such as steel (e.g., stainless steel), to prevent bending of the nip formation pad 23. Alternatively, the support 24 may be made of resin having a mechanical strength great enough to prevent bending of the nip formation pad 23.

If the heater 26 is a heater or a heat source such as a halogen heater that heats the fixing belt 21 by radiant heat, an opposed face of the support 24 disposed opposite the heater 26 is partially or entirely coated with an insulator or treated with bright annealing (BA) or mirror polishing. Accordingly, heat radiated from the heater 26 toward the support 24, that is, heat or light that may heat the support 24, is used to heat the thermal conductor 25, improving heating efficiency of heating the fixing belt 21 through the thermal conductor 25.

A detailed description is now given of a configuration of the thermal conductor 25.

The thermal conductor 25 is a tube or a pipe having a thickness not greater than 0.2 mm. The thermal conductor 25 may be made of conductive metal such as aluminum, iron, and stainless steel. The thermal conductor 25 is mounted on and supported by the side plate of the fixing device 20 at each lateral end of the thermal conductor 25 in a longitudinal direction thereof parallel to the axial direction of the fixing belt 21. The thermal conductor 25 is disposed in proximity to or in contact with the inner circumferential surface of the fixing belt 21 at a circumferential span on the fixing belt 21 other than the fixing nip N. At the fixing nip N, the thermal conductor 25 includes a recess accommodating the nip formation pad 23 and having a slit.

The heater 26 heats the thermal conductor 25 by radiant heat or light, which in turn heats the fixing belt 21. That is, the heater 26 heats the thermal conductor 25 directly and heats the fixing belt 21 indirectly through the thermal conductor 25. The heater 26 does not heat a part of the fixing belt 21 locally but does heat the fixing belt 21 through the thermal conductor 25 throughout the substantially entire span in a circumferential direction of the fixing belt 21. Accordingly, even if the fixing belt 21 rotates at high speed, the heater 26 heats the fixing belt 21 sufficiently, suppressing fixing failure. The thermal conductor 25 having the thickness not greater than 0.2 mm conducts heat from the heater 26 to the fixing belt 21 effectively.

At an ambient temperature, a gap between the fixing belt 21 and the thermal conductor 25 produced at the circumferential span on the fixing belt 21 other than the fixing nip N is greater than 0 mm and not greater than 1 mm. Hence, the fixing belt 21 slides over the thermal conductor 25 in a decreased area, suppressing abrasion of the fixing belt 21 that may accelerate as the fixing belt 21 slides over the thermal conductor 25 in an increased area. Simultaneously, the fixing belt 21 is not isolated from the thermal conductor 25 with an excessively increased gap therebetween, suppressing degradation in heating efficiency in heating the fixing belt 21. Additionally, the thermal conductor 25 disposed in proximity to the fixing belt 21 retains a circular shape of the flexible fixing belt 21, reducing deformation and resultant degradation and breakage of the fixing belt 21. In order to decrease resistance between the thermal conductor 25 and the fixing belt 21 sliding thereover, a slide face, that is, an outer circumferential surface, of the thermal conductor 25 may be made of a material having a decreased friction coefficient or the inner circumferential surface of the fixing belt 21 may be coated with a surface layer made of a material containing fluorine.

As illustrated in FIG. 2, the thermal conductor 25 is substantially circular in cross-section. Alternatively, the thermal conductor 25 may be polygonal in cross-section. If the fixing device 20 includes a separate component that conducts heat from the heater 26 to the fixing belt 21 evenly and stabilizes motion of the fixing belt 21 as the fixing belt 21 is driven, the fixing device 20 may employ a direct heating method in which the heater 26 heats the fixing belt 21 directly without the thermal conductor 25. In this case, the fixing device 20 reduces its total thermal capacity by a thermal capacity of the thermal conductor 25, heating the fixing belt 21 quickly and saving energy.

FIG. 2 illustrates a halogen heater used as the heater 26. Alternatively, other heaters may be used as the heater 26. For example, the fixing device 20 may employ an induction heater. Output of the heater 26 is controlled based on the temperature of the outer circumferential surface of the fixing belt 21 detected by the temperature sensor 27. The temperature sensor 27 includes a thermistor disposed opposite the outer circumferential surface of the fixing belt 21. Thus, the fixing belt 21 is heated to a desired fixing temperature by the heater 26 controlled as described above.

A detailed description is now given of a construction of the pressurization assembly 28.

The pressurization assembly 28 includes a pressure lever 40 and a pressure spring 41. The pressure lever 40 is pivotably mounted on and supported by the side plate of the fixing device 20 such that the pressure lever 40 is pivotable about a shaft 40*a* at one end of the pressure lever 40 in a longitudinal direction thereof. A center of the pressure lever 40 in the longitudinal direction thereof contacts the bearing of the pressure roller 22. Another end of the pressure lever 40 in the longitudinal direction thereof is anchored with the pressure spring 41. As the pressure lever 40 rotates about the shaft 40*a*, the pressure lever 40 moves the pressure roller 22 horizontally in FIG. 2 in a direction D40. The bearing of the pressure roller 22 strikes a detent which halts the pressure roller 22. During a fixing job, the pressure roller 22 is pressed against the fixing belt 21 to form the desired fixing nip N between the pressure roller 22 and the fixing belt 21. Conversely, during times other than the fixing job, for example, while a user removes the sheet P jammed between the fixing belt 21 and the pressure roller 22 or the fixing device 20 is in a standby mode, the pressure roller 22 is isolated from the fixing belt 21 or pressed against the fixing belt 21 with decreased pressure therebetween.

A detailed description is now given of a configuration of the separator 29.

The separator 29 is disposed downstream from the fixing nip N in a sheet conveyance direction D2 and disposed opposite the outer circumferential surface of the fixing belt 21. The separator 29 is isolated from the outer circumferential surface of the fixing belt 21 at least in a conveyance span or an imaged span of the fixing belt 21 in the axial direction thereof where an imaged region, that is, the toner image T, on the sheet P is conveyed over the fixing belt 21. Accordingly, the conveyance span on the outer circumferential surface of the fixing belt 21 is immune from abrasion due to contact with the separator 29, preventing the fixing belt 21 from producing gloss streaks on the toner image T on the sheet P.

A description is provided of a fixing operation performed by the fixing device 20 having the construction described above.

As the image forming apparatus 1 is powered on, the heater 26 is supplied with power and the driver starts driving and rotating the pressure roller 22 clockwise in FIG. 2 in the rotation direction D22. Accordingly, the pressure roller 22 drives and rotates the fixing belt 21 in the rotation direction D21 by friction therebetween. As illustrated in FIG. 1, the feed roller 11 picks up and feeds a sheet P from the paper tray 10 to the registration roller pair 12 that conveys the sheet P to the secondary transfer nip where an unfixed toner image T is secondarily transferred from the intermediate transfer belt 30 onto the sheet P. As illustrated in FIG. 2, the sheet P bearing the unfixed toner image T is conveyed in the sheet conveyance direction D1 and enters the fixing nip N formed between the fixing belt 21 and the pressure roller 22 pressed against the fixing belt 21. The toner image T is fixed on a surface of the sheet P under heat from the fixing belt 21 heated by the heater 26 through the thermal conductor 25 while the fixing belt 21 slides over the nip formation pad 23 and pressure exerted from the fixing belt 21 and the pressure roller 22 pressed against the nip formation pad 23 supported by the support 24 via the fixing belt 21. The sheet P is ejected from the fixing nip N, separated from the fixing belt 21 by the separator 29, and conveyed in the sheet conveyance direction D2.

The fixing belt 21 is not rotatable about a plurality of axes defined by a plurality of supports (e.g., a plurality of rollers) over which the fixing belt 21 is looped. The fixing belt 21 is rotatable about a single axis and supported by the tubular thermal conductor 25. While the fixing belt 21 rotates in the rotation direction D21, a trajectory of the fixing belt 21 bulges radially outward at a position disposed downstream from the fixing nip N in the sheet conveyance direction D2 compared to while the fixing belt 21 halts. Since the base layer of the fixing belt 21 is made of resin, the fixing belt 21 is susceptible to deformation compared to the fixing belt 21 incorporating the base layer made of metal. Thus, the fixing belt 21 bulges radially outward with an increased amount. While the fixing belt 21 bulges radially outward at the position disposed downstream from the fixing nip N in the sheet conveyance direction D2, the fixing belt 21 does not achieve an increased curvature at a position in proximity to an exit of the fixing nip N. Additionally, since the contact face 23*a* of the nip formation pad 23 that contacts the fixing belt 21 is planar, the fixing nip N (e.g., the exit of the fixing nip N) is straight in cross-section. Hence, the trajectory of the fixing belt 21 is substantially straight at the position in proximity to the exit of the fixing nip N.

In order to facilitate the separator 29 isolated from the fixing belt 21 to separate the sheet P from the fixing belt 21, a front end of the separator 29 is isolated from the exit of the fixing nip N with an increased interval therebetween to achieve the increased curvature of the fixing belt 21 as illustrated in FIG. 2. However, if the sheet P ejected from the fixing nip N is conveyed while the sheet P is in contact with or in proximity to the fixing belt 21, the front end of the separator 29 isolated from the exit of the fixing nip N with the increased interval may cause the sheet P to receive heat from the fixing belt 21 excessively, resulting in failures such as hot offset and decreased gloss of the toner image T on the sheet P.

A description is provided of a configuration of a comparative fixing device for explaining failures such as hot offset and decreased gloss of the toner image T on the sheet P.

The comparative fixing device includes an endless fixing belt not looped over a plurality of rollers and rotatable about a single axis. The fixing belt is rotatably supported by a tubular pipe, a tubular flange, or the like at each lateral end of the fixing belt in an axial direction thereof.

Like a fixing roller, a sheet may be wound around the fixing belt. To address this circumstance, a separator may separate the sheet from the fixing belt.

A front end of the separator may be configured to contact or not to contact the fixing belt. If the front end of the separator is configured to contact the fixing belt, the separator separates the sheet from the fixing belt precisely. However, an outer circumferential surface of the fixing belt is susceptible to abrasion due to contact with the separator. The fixing belt suffering from abrasion may scratch a toner image on the sheet, resulting in formation of a faulty toner image having gloss streaks or the like. Conversely, if the front end of the separator is configured not to contact the fixing belt, the separator does not separate the sheet from the fixing belt precisely. However, the separator does not cause the fixing belt to form the faulty toner image having gloss streaks or the like.

Figure 3:
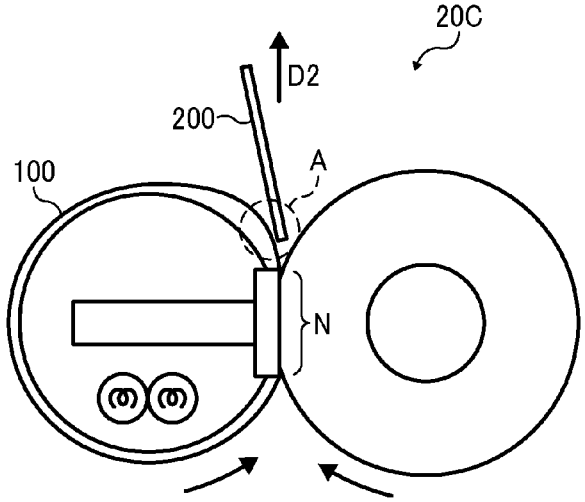
FIG. 3 (PRIOR ART)
FIG. 3 is a schematic vertical cross-sectional view of a comparative fixing device.

FIG. 3 is a schematic vertical cross-sectional view of a comparative fixing device 20C. As illustrated in FIG. 3, the comparative fixing device 20C includes a fixing belt 100 rotatable about a single axis. The fixing belt 100 may bulge radially outward at a position disposed downstream from a fixing nip N in the sheet conveyance direction D2, that is, at a position above the fixing nip N in FIG. 3. Accordingly, the fixing belt 100 is not bent with an increased curvature at a position in proximity to the exit of the fixing nip N that is marked in a dotted circle A. Hence, a decreased curvature of the fixing belt 100 does not separate a sheet from the fixing belt 100.

Figure 4:
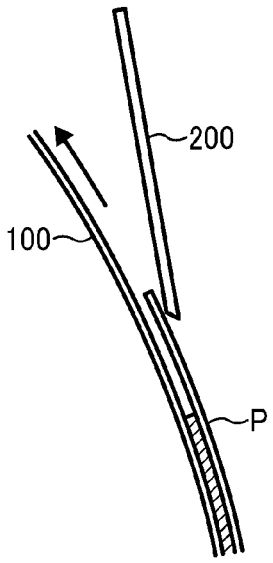
FIG. 4 (PRIOR ART)
FIG. 4 is a partially enlarged cross-sectional view of a fixing belt and a separator incorporated in the comparative fixing device depicted in FIG. 3.

FIG. 4 is a partially enlarged cross-sectional view of the fixing belt 100 and a separator 200 of the comparative fixing device 20C. Since the separator 200 is disposed opposite the fixing belt 100 with an interval therebetween at a decreased curvature part of the fixing belt 100 that has the decreased curvature, a sheet P may move through the interval between the fixing belt 100 and the separator 200. Thus, the separator 200 may not separate the sheet P from the fixing belt 100. Additionally, since the planar fixing nip N is straight in cross-section as illustrated in FIG. 3, a trajectory of the fixing belt 100 is substantially straight at the position downstream from the fixing nip N in the sheet conveyance direction D2, degrading separation of the sheet P from the fixing belt 100 by the separator 200.

Figure 5:
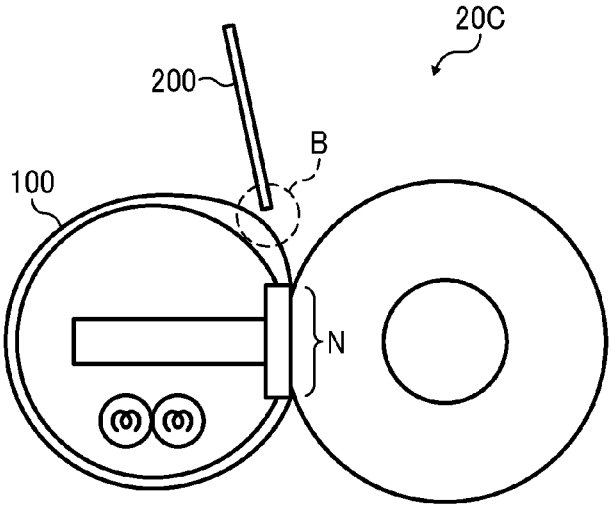
FIG. 5 (PRIOR ART)
FIG. 5 is a schematic vertical cross-sectional view of the comparative fixing device depicted in FIG. 3 illustrating the separator and an increased curvature part of the fixing belt.
Figure 6:
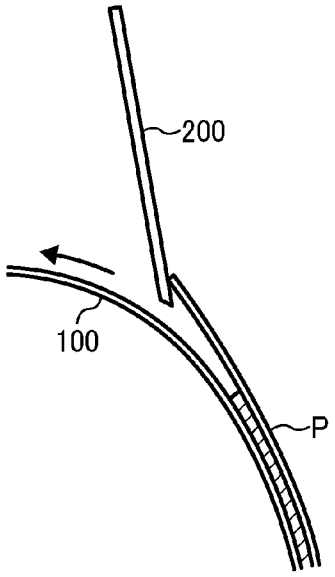
FIG. 6 (PRIOR ART)
FIG. 6 is a partially enlarged cross-sectional view of the fixing belt and the separator depicted in FIG. 5 that is disposed opposite the increased curvature part of the fixing belt.

In order to facilitate the separator 200 isolated from the fixing belt 100 rotatable about the single axis to separate the sheet P from the fixing belt 100, as illustrated in FIG. 5, the separator 200 is disposed opposite the fixing belt 100 at an increased curvature part of the fixing belt 100 that is marked in a dotted circle B where the fixing belt 100 achieves an increased curvature. FIG. 5 is a schematic vertical cross-sectional view of the comparative fixing device 20C illustrating the separator 200 and the increased curvature part of the fixing belt 100. FIG. 6 is a partially enlarged cross-sectional view of the fixing belt 100 and the separator 200 disposed opposite the increased curvature part of the fixing belt 100. As illustrated in FIG. 6, since the separator 200 is disposed opposite the fixing belt 100 at the increased curvature part of the fixing belt 100, the increased curvature of the fixing belt 100 facilitates separation of the sheet P from the fixing belt 100. Accordingly, a leading edge of the sheet P comes into contact with the separator 200 which separates the sheet P from the fixing belt 100 precisely.

However, the separator 200 disposed opposite the increased curvature part of the fixing belt 100 as illustrated in FIG. 5 may cause the sheet P to receive heat from the fixing belt 100 excessively, resulting in failures such as hot offset and decreased gloss of the toner image on the sheet P. For example, since the front end of the separator 200 is separated from the exit of the fixing nip N with an increased distance therebetween, as the sheet P is ejected from the fixing nip N, the sheet P is conveyed while the sheet P is in contact with or in proximity to the fixing belt 100 until the sheet P reaches the front end of the separator 200. Accordingly, the sheet P receives an increased amount of heat from the fixing belt 100 compared to when the sheet P is separated from the fixing belt 100 immediately after the sheet P is ejected from the fixing nip N. Consequently, toner of the toner image on the sheet P may receive heat from the fixing belt 100 excessively and may adhere to the fixing belt 100, resulting in failures such as hot offset and decreased gloss of the toner image on the sheet P. Such failures may occur frequently with toner having a low melting point. To address this circumstance, the fixing device 20 has a configuration described below.

Figure 7:
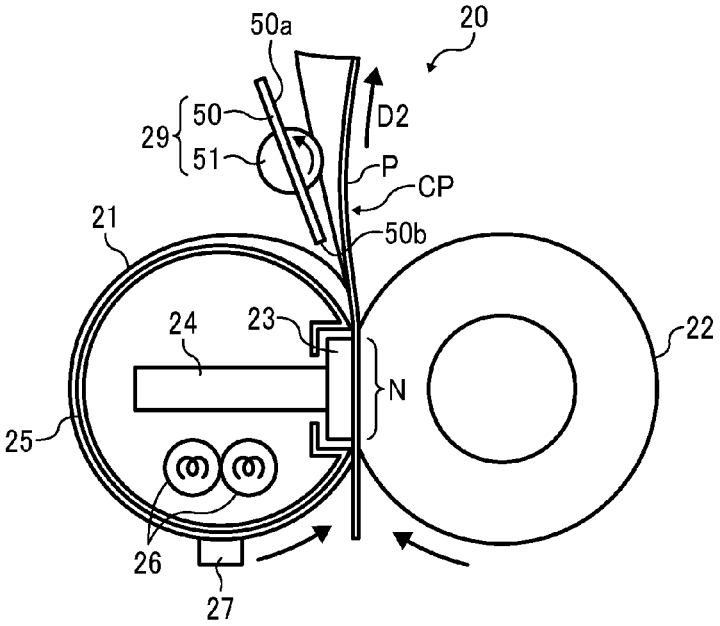
FIG. 7 is a partial vertical cross-sectional view of the fixing device depicted in FIG. 2.
Figure 8:
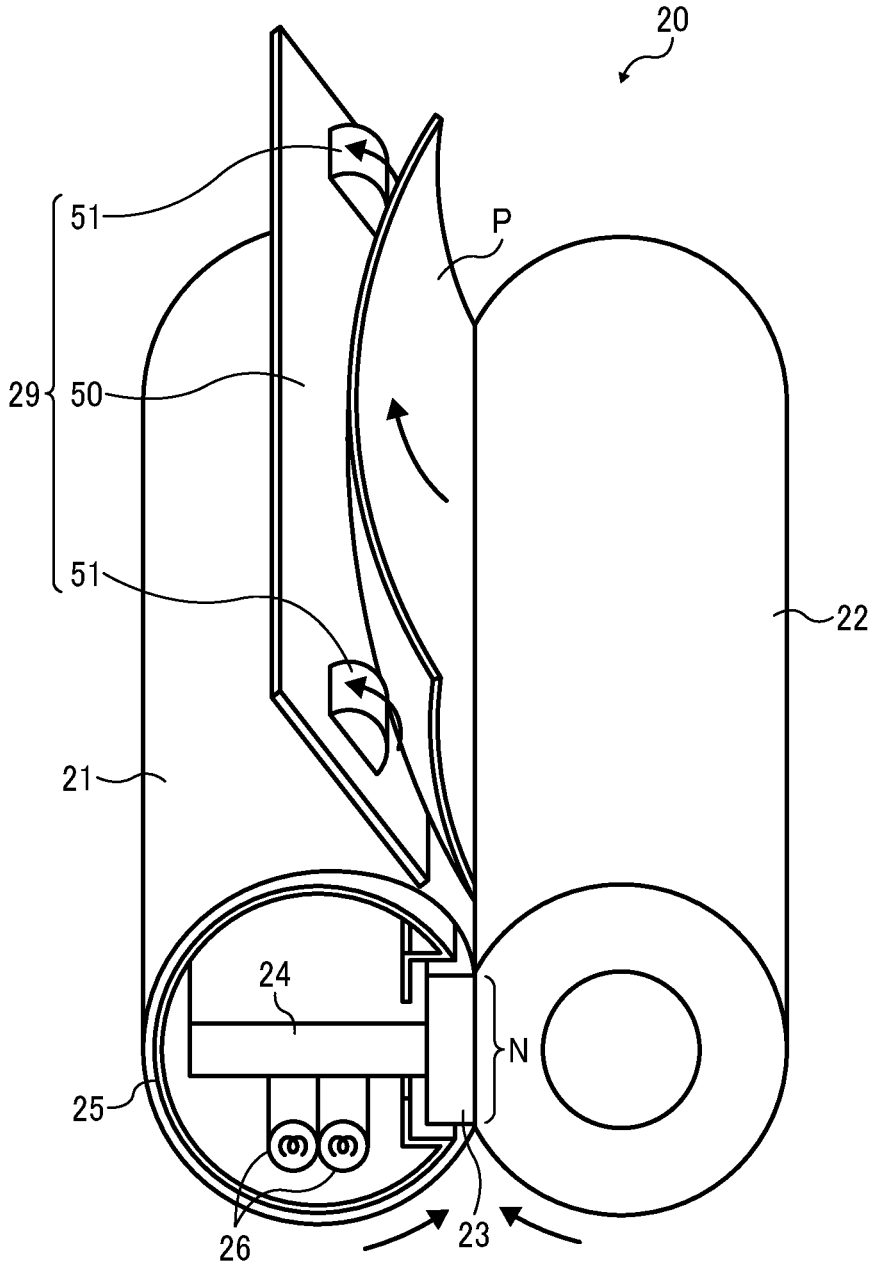
FIG. 8 is a partial perspective view of the fixing device depicted in FIG. 7.

FIG. 7 is a partial vertical cross-sectional view of the fixing device 20. FIG. 8 is a partial perspective view of the fixing device 20. As illustrated in FIGS. 7 and 8, the separator 29 includes a separation plate 50 serving as a separation body and a separation roller 51 serving as a rotary separation aid rotatably mounted on the separation plate 50. The separation plate 50 is a plate continuously extending throughout the entire width of the fixing belt 21 in the axial direction thereof. The separation plate 50 includes a conveyance path side face 50*a* and a front end 50*b*. The conveyance path side face 50*a* is disposed opposite a conveyance path CP through which the sheet P is conveyed. The front end 50*b*, that is, a lower end in FIG. 7, is disposed in proximity to the outer circumferential surface of the fixing belt 21. The separation roller 51 projects beyond the conveyance path side face 50*a* of the separation plate 50 toward the conveyance path CP. The separation roller 51 is supported by the separation plate 50 such that the separation roller 51 is rotatable about a shaft extending in the axial direction of the fixing belt 21.

Since the separation roller 51 mounted on the separation plate 50 projects toward the conveyance path CP, as the sheet P having passed through the fixing nip N comes into contact with the separation roller 51, the separation roller 51 directs and conveys the sheet Pin a direction in which the sheet P separates from the fixing belt 21. Accordingly, the separation roller 51 prevents the sheet P having passed through the fixing nip N from being conveyed while the sheet P is in contact with or in proximity to the fixing belt 21. Consequently, the sheet P does not receive heat from the fixing belt 21 excessively, preventing failures such as hot offset and decreased gloss of the toner image T on the sheet P.

As illustrated in FIG. 8, the separation roller 51 is disposed at each lateral end of the separation plate 50 in the axial direction of the fixing belt 21 intersecting the sheet conveyance direction D2. Hence, as the sheet P comes into contact with the separation rollers 51, the sheet P is conveyed such that the sheet P is bent or warped throughout the entire width of the sheet P in the axial direction of the fixing belt 21. The warped sheet P attains an increased rigidity that prevents the sheet P from tilting toward the fixing belt 21. Accordingly, the separation roller 51 prevents the sheet P from being conveyed while the sheet P is in contact with or in proximity to the fixing belt 21. Consequently, the separation roller 51 prevents overheating of the sheet P precisely.

When the sheet P contacts the separation roller 51, the separation roller 51 is rotated by the sheet P conveyed in the sheet conveyance direction D2 and therefore does not scratch the toner image T on the sheet P, preventing degradation of the toner image T. None of the components of the separator 29 including the separation plate 50 and the separation roller 51 contact the fixing belt 21 at least in the imaged span of the fixing belt 21 in the axial direction thereof where the imaged region, that is, the toner image T, on the sheet P is conveyed. None of the components of the separator 29 contact the outer circumferential surface of the fixing belt 21, preventing formation of a faulty toner image such as a toner image having gloss streaks. In order to reduce toner that may adhere from the sheet P to the separation roller 51 and stain the separation roller 51 when the sheet P comes into contact with the separation roller 51, the separation roller 51 is made of a material that facilitates separation or peeling off of toner from the separation roller 51, such as PFA.

Figure 9B:
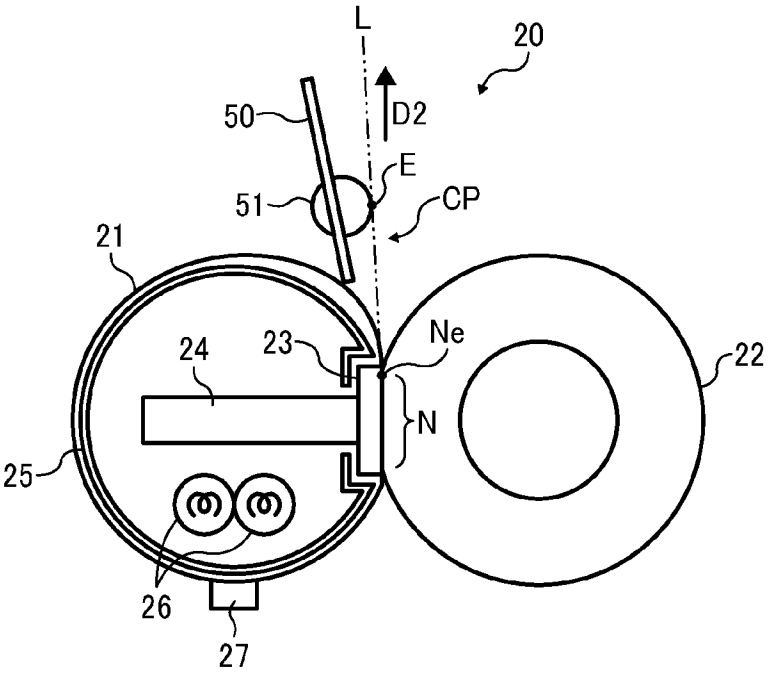
FIG. 9B is a partial vertical cross-sectional view of the fixing device depicted in FIG. 2 illustrating the separation roller projecting beyond the separation plate with an increased amount.
Figure 9A:
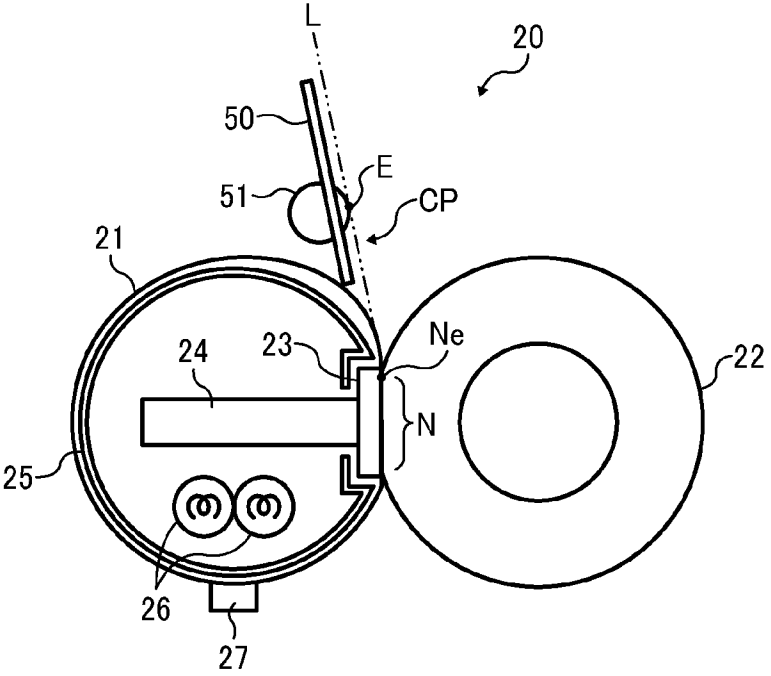
FIG. 9A is a partial vertical cross-sectional view of the fixing device depicted in FIG. 2 illustrating a separation roller projecting beyond a separation plate with a decreased amount.

FIG. 9A is a partial vertical cross-sectional view of the fixing device 20 illustrating the separation roller 51 projecting beyond the separation plate 50 with a decreased amount. FIG. 9B is a partial vertical cross-sectional view of the fixing device 20 illustrating the separation roller 51 projecting beyond the separation plate 50 with an increased amount. The separation roller 51 depicted in FIG. 9B separates the sheet P from the fixing belt 21 farther than the separation roller 51 depicted in FIG. 9A. That is, the separation roller 51 projecting beyond the separation plate 50 toward the conveyance path CP with the increased amount separates the sheet P from the fixing belt 21 more precisely than the separation roller 51 projecting with the decreased amount. For example, as illustrated in FIG. 9B, a hypothetical line L is defined by a downstream end Ne of the fixing nip N in the sheet conveyance direction D2 and a projection summit E of the separation roller 51 projecting toward the conveyance path CP. The separation roller 51 is positioned relative to the separation plate 50 such that the hypothetical line L does not overlap or intersect the trajectory of the fixing belt 21 at the position downstream from the fixing nip N in the sheet conveyance direction D2.

Figure 10A:
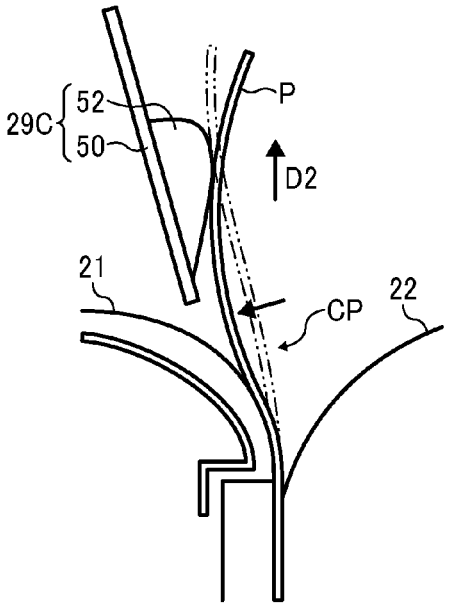
FIG. 10A (PRIOR ART)
FIG. 10A is a cross-sectional view of a comparative separator incorporating a rib.

Alternatively, in order to convey the sheet P ejected from the fixing nip N such that the sheet P separates from the fixing belt 21, instead of the separation roller 51 projecting beyond the separation plate 50, a rib 52 that is not rotatable may be mounted on the separation plate 50 to project beyond the separation plate 50 toward the conveyance path CP as illustrated in FIG. 10A. FIG. 10A is a cross-sectional view of a comparative separator 29C incorporating the rib 52. However, the rib 52 increases a resistance between the rib 52 and the sheet P when the sheet P comes into contact with the rib 52. Hence, as illustrated in FIG. 10A, the sheet P is bent toward the fixing belt 21 at a position upstream from a contact position where the sheet P contacts the rib 52 in the sheet conveyance direction D2. Accordingly, the rib 52 may not isolate the sheet P from the fixing belt 21 with an increased interval therebetween effectively. Consequently, the rib 52 may not sufficiently reduce heat conduction from the fixing belt 21 to the sheet P that may adversely affect the toner image T on the sheet P.

Figure 10B:
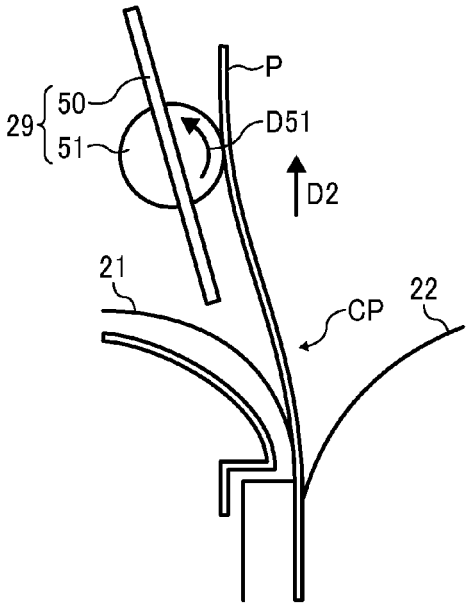
FIG. 10B is a cross-sectional view of a separator incorporated in the fixing device depicted in FIG. 2.

Conversely, as illustrated in FIG. 10B, the separation roller 51 is rotated in a rotation direction D51 by the sheet P conveyed in the sheet conveyance direction D2. FIG. 10B is a cross-sectional view of the separator 29 incorporating the separation roller 51. Since the separation roller 51 rotates in the rotation direction D51, even if the sheet P comes into contact with the separation roller 51, the sheet P is barely applied with a resistance from the separation roller 51 and therefore barely suffers from bending unlike the sheet P that comes into contact with the rib 52 depicted in FIG. 10A. Accordingly, the separation roller 51 isolates the sheet P from the fixing belt 21 with an increased interval therebetween effectively. Consequently, the separation roller 51 sufficiently reduces heat conduction from the fixing belt 21 to the sheet P, which may adversely affect the toner image T on the sheet P. Thus, the separation roller 51 prevents overheating of the sheet P by the fixing belt 21 more effectively than the rib 52 depicted in FIG. 10A.

A description is provided of an examination performed to examine advantages of the separator 29.

Table 1 below indicates a result of the examination. The examination was performed for an exemplary configuration of an exemplary separator incorporating a separation roller rotatably mounted on a separation plate like the separator 29 depicted in FIG. 10B, a first comparative configuration of a first comparative separator incorporating a rib, instead of the separation roller, mounted on the separation plate, and a second comparative configuration of a second comparative separator incorporating neither the separation roller nor the rib. An outermost amount of projection of the separation roller of the exemplary separator projecting beyond the separation plate toward the conveyance path CP was equal to an outermost amount of projection of the rib of the first comparative separator toward the conveyance path CP. With the exemplary separator, the first comparative separator, and the second comparative separator, the temperature of the fixing belt 21 changed by 5 degrees centigrade within a range of from 160 degrees centigrade to 190 degrees centigrade. Under each temperature, a sheet bearing a solid toner image on a front end of the sheet in a sheet conveyance direction was conveyed through the fixing nip N and the quality of the toner image was evaluated. The solid toner image was adhered with toner of 5 g/m$^2$. The quality of the toner image was evaluated in five grades from Grade 1 to Grade 5. Grade 5 denotes a highest quality of the toner image. Grades 3 to 5 denote an allowable quality range of the toner image.

TABLE 1

| Temperature of fixing belt (° C.) | Exemplary separator incorporating separation roller | First comparative separator incorporating rib | Second comparative separator without separation roller and rib |
|---|---|---|---|
| 160 | 5 | 5 | 5 |
| 165 | 5 | 5 | 4 |
| 170 | 5 | 4 | 3 |
| 175 | 4 | 3 | 2 |
| 180 | 4 | 2 | 2 |
| 185 | 2 | 2 | 2 |
| 190 | 2 | 2 | 2 |

As illustrated in Table 1, when the temperature of the fixing belt 21 was 175 degrees or higher, the second comparative separator incorporating neither the separation roller nor the rib obtained Grade 2 outside the allowable quality range, thus being evaluated worst among the three separators examined. By contrast, the first comparative separator incorporating the rib achieved a better result, that is, Grade 3, even when the temperature of the fixing belt 21 was 175 degrees centigrade. The exemplary separator incorporating the separation roller achieved an even better result, that is, Grade 4, even when the temperature of the fixing belt 21 was 180 degrees centigrade.

The result of the examination depicted in Table 1 revealed that the exemplary separator achieved the quality of the toner image within the allowable quality range even at high temperatures of the fixing belt 21 compared to the first comparative separator and the second comparative separator. For example, according to a comparison at an identical temperature of 170 degrees centigrade, the exemplary separator achieved Grade 5, the first comparative separator achieved Grade 4, and the second comparative separator achieved Grade 3. Thus, the exemplary separator achieved an enhanced quality of the toner image compared to the first comparative separator and the second comparative separator.

It is conjectured from the result of the examination that the rib of the first comparative separator separated the sheet from the fixing belt 21 farther than the second comparative separator without the separation roller and the rib. As a result, the first comparative separator achieved a certain advantage to decrease thermal degradation of the toner image on the sheet caused by heat conducted from the fixing belt 21. However, with the first comparative separator, since the resistance between the rib and the sheet contacting the rib bent the sheet toward the fixing belt 21 as described above, it is presumed that the first comparative separator did not achieve an advantage equivalent to an advantage of the exemplary separator. Conversely, with the exemplary separator, the separation roller rotated to reduce the resistance imposed on the sheet. Accordingly, the sheet barely bent and the separation roller separated the sheet from the fixing belt 21 effectively. Consequently, the separation roller further reduced thermal degradation of the sheet that might be caused by heat from the fixing belt 21.

A description is provided of a detailed construction of the separator 29.

Figure 11:
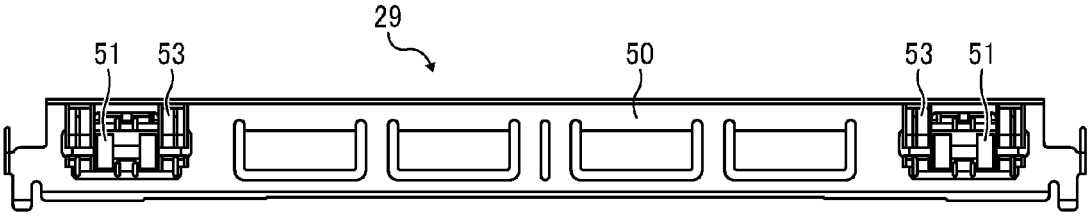
FIG. 11 is a plan view of the separator depicted in FIG. 10B.

FIG. 11 is a plan view of the separator 29. As illustrated in FIG. 11, in addition to the separation plate 50 and the separation roller 51 mounted on the separation plate 50, the separator 29 further includes a holder 53 that rotatably holds the separation roller 51 to mount the separation roller 51 on the separation plate 50.

Figure 12:
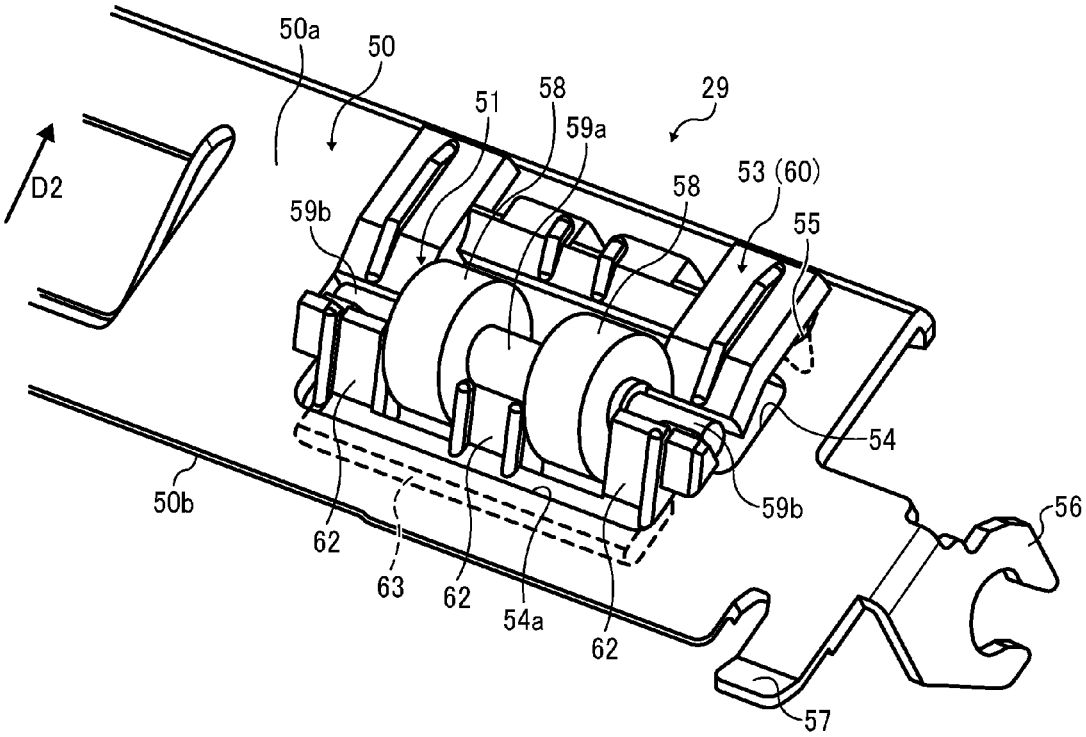
FIG. 12 is a partial perspective view of the separator depicted in FIG. 11 illustrating one lateral end of the separator in a longitudinal direction thereof.
Figure 13:
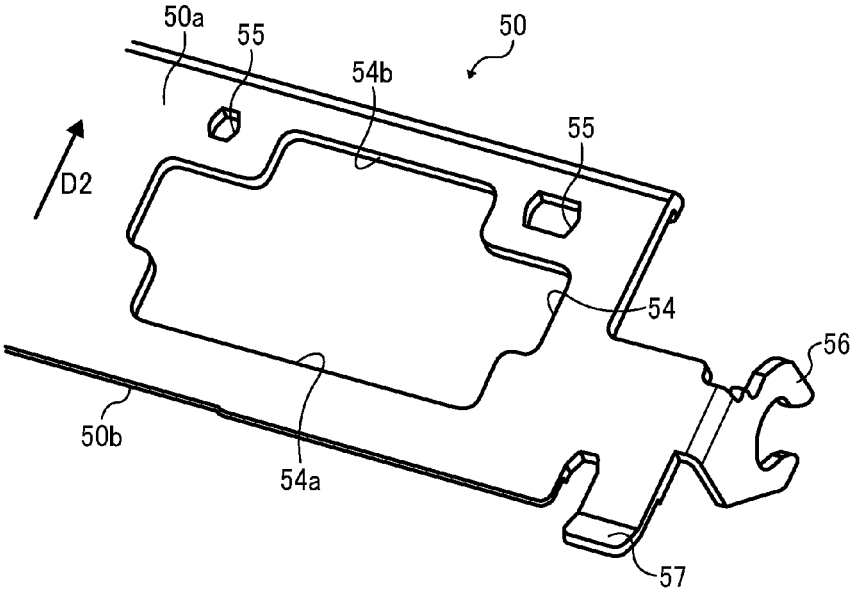
FIG. 13 is a partial perspective view of the separation plate incorporated in the separator depicted in FIG. 12.
Figure 14:
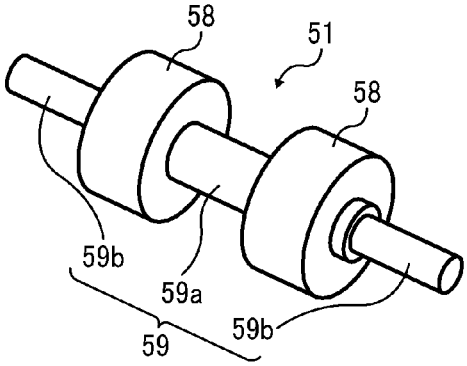
FIG. 14 is a perspective view of the separation roller incorporated in the separator depicted in FIG. 12.
Figure 15A:
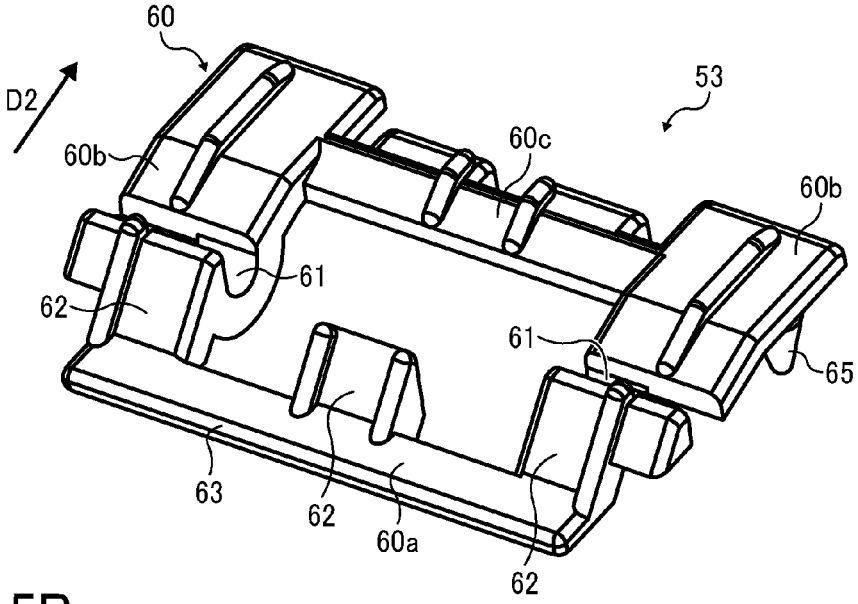
FIG. 15A is a perspective view of a holder incorporated in the separator depicted in FIG. 12 seen from a conveyance path where a recording medium is conveyed.
Figure 15B:
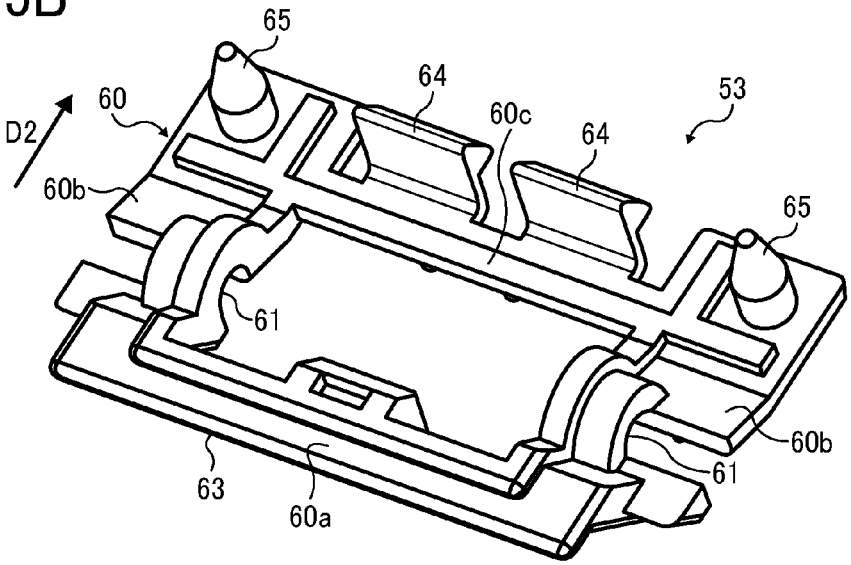
FIG. 15B is a perspective view of the holder depicted in FIG. 15A seen from a side opposite the conveyance path.

FIG. 12 is a partial perspective view of the separator 29 illustrating one lateral end of the separator 29 in a longitudinal direction thereof parallel to the axial direction of the fixing belt 21 that is seen from the conveyance path CP depicted in FIG. 10B. FIG. 13 is a partial perspective view of the separation plate 50. FIG. 14 is a perspective view of the separation roller 51. FIG. 15A is a perspective view of the holder 53 seen from the conveyance path CP. FIG. 15B is a perspective view of the holder 53 seen from a side opposite the conveyance path CP. Since one lateral end of the separator 29 in the longitudinal direction thereof is symmetrical with another lateral end of the separator 29 in the longitudinal direction thereof, a description is provided of a configuration of one lateral end of the separator 29 in the longitudinal direction thereof illustrated in FIGS. 12, 13, 14, 15A, and 15B.

A detailed description is now given of a construction of the separation plate 50.

As illustrated in FIGS. 12 and 13, the separation plate 50 includes a primary through-hole 54 and a plurality of secondary through-holes 55 at one lateral end of the separation plate 50 in a longitudinal direction thereof parallel to the longitudinal direction of the separator 29. The primary through-hole 54 accommodates the holder 53 and the separation roller 51. Each of the secondary through-holes 55 is inserted with a projection described below of the holder 53.

An arm 56 is disposed outboard from the primary through-hole 54 in the longitudinal direction of the separation plate 50. The separation plate 50 further includes the conveyance path side face 50*a* disposed opposite the conveyance path CP. The arm 56 projects from a lateral edge of the separation plate 50 in the longitudinal direction thereof in a direction perpendicular to or intersecting the conveyance path side face 50*a*. The arm 56 is substantially C-shaped in cross-section to define a center recess. As a shaft mounted on the side plate of the fixing device 20 is inserted into the center recess of the arm 56, the separation plate 50 is supported by the side plate such that the separation plate 50 is pivotable about the shaft. Accordingly, the front end 50*b* of the separation plate 50 is movable with respect to the outer circumferential surface of the fixing belt 21. For example, the front end 50*b* of the separation plate 50 moves closer to and away from the outer circumferential surface of the fixing belt 21.

The separation plate 50 further includes an abutment 57 disposed between the arm 56 and the primary through-hole 54 in the longitudinal direction of the separation plate 50. A biasing member (e.g., a spring) biases the separation plate 50 against the fixing belt 21 to move the front end 50*b* of the separation plate 50 toward the fixing belt 21. For example, a biasing force of the biasing member brings the abutment 57 into contact with the outer circumferential surface of the fixing belt 21. The abutment 57 contacting the outer circumferential surface of the fixing belt 21 retains a predetermined interval between the front end 50*b* of the separation plate 50 and the outer circumferential surface of the fixing belt 21. Thus, the front end 50*b* of the separation plate 50 is isolated from the fixing belt 21 at least in the conveyance span of the fixing belt 21 in the axial direction thereof where the imaged region on the sheet P is conveyed. Since the abutment 57 is disposed outboard from the conveyance span of the fixing belt 21 in the axial direction thereof, even if the abutment 57 contacts the outer circumferential surface of the fixing belt 21, the abutment 57 does not scratch the conveyance span of the fixing belt 21 and therefore does not cause the fixing belt 21 to damage the toner image T on the sheet P into a faulty toner image having gloss streaks or the like.

A detailed description is now given of a construction of the separation roller 51.

As illustrated in FIG. 12, the separation roller 51 includes two rollers 58 aligned in the longitudinal direction of the separation plate 50 with an interval between the rollers 58. As illustrated in FIG. 14, the separation roller 51 further includes a shaft 59 serving as a rotation axis of each of the rollers 58. Alternatively, the separation roller 51 may include a single roller 58 or three or more rollers 58. The shaft 59 includes an intermediate shaft portion 59*a* interposed between the rollers 58 and two lateral end shaft portions 59*b*. Each of the lateral end shaft portions 59*b* is disposed outboard from the center shaft portion 59*a* in an axial direction of the shaft 59. That is, each of the lateral end shaft portions 59*b* is disposed opposite the intermediate shaft portion 59*a* via the roller 58 in the axial direction of the shaft 59. A diameter of the intermediate shaft portion 59*a* is greater than a diameter of the respective lateral end shaft portions 59*b* to enhance the mechanical strength of the shaft 59.

A detailed description is now given of a construction of the holder 53.

As illustrated in FIGS. 12, 15A, and 15B, the holder 53 includes a substantially rectangular frame 60 surrounding the rollers 58 of the separation roller 51. The frame 60, disposed downstream from the rollers 58 in the sheet conveyance direction D2, includes an upstream portion 60*a*, a pair of side portions 60*b*, and a downstream portion 60*c*. The upstream portion 60*a* extends in an axial direction of the respective rollers 58. The pair of side portions 60*b* is disposed outboard from the rollers 58 in the axial direction thereof. For example, the pair of side portions 60*b* sandwiches the rollers 58 in the axial direction thereof. The pair of side portions 60*b* adjoins each lateral end of the upstream portion 60*a* in the axial direction of the rollers 58. The downstream portion 60*c*, disposed downstream from the rollers 58 in the sheet conveyance direction D2, bridges the pair of side portions 60*b*.

As illustrated in FIGS. 15A and 15B, each of the side portions 60*b* mounts a bearing 61 that rotatably bears the lateral end shaft portion 59*b* of the separation roller 51 depicted in FIG. 12. As illustrated in FIG. 15A, the holder 53 further includes a plurality of guide faces 62 that guides the sheet P to the separation roller 51. For example, two guide faces 62 are disposed upstream from the bearings 61, respectively, in the sheet conveyance direction D2. One guide face 62 is disposed at a center of the upstream portion 60*a* in the axial direction of the rollers 58. As illustrated in FIG. 12, as the separation roller 51 is attached to the holder 53, the guide faces 62 are disposed upstream from the intermediate shaft portion 59*a* and the lateral end shaft portions 59*b* of the separation roller 51, respectively, in the sheet conveyance direction D2. As the holder 53 attached with the separation roller 51 is attached to the separation plate 50, each of the guide faces 62 projects beyond the conveyance path side face 50*a* of the separation plate 50 toward the conveyance path CP such that a projection amount of each guide face 62 increases gradually in the sheet conveyance direction D2.

The upstream portion 60*a* (e.g., an upstream end of the upstream portion 60*a* in the sheet conveyance direction D2) depicted in FIG. 15A serves as an upstream engagement 63 depicted in FIG. 12 to engage an upstream edge 54*a* in the sheet conveyance direction D2 of the primary through-hole 54 of the separation plate 50. Conversely, the downstream portion 60*c* depicted in FIG. 15B mounts a pair of downstream engagements 64 to engage a downstream edge 54*b* in the sheet conveyance direction D2 of the primary through-hole 54 of the separation plate 50 depicted in FIG. 13. As illustrated in FIG. 15B, each of the downstream engagements 64 is a claw projecting from the downstream portion 60*c* in a direction opposite the sheet conveyance path CP and being elastically displaced upstream and downstream in the sheet conveyance direction D2. A plurality of projections 65 is disposed downstream from the side portions 60*b*, respectively, in the sheet conveyance direction D2. Each of the projections 65 is inserted into the respective secondary through-holes 55 of the separation plate 50 depicted in FIG. 13. Each of the projections 65 is a pin projecting from the side portion 60*b* in the direction opposite the sheet conveyance path CP.

A description is provided of a method for attaching the holder 53 to the separation plate 50.

Figure 16B:
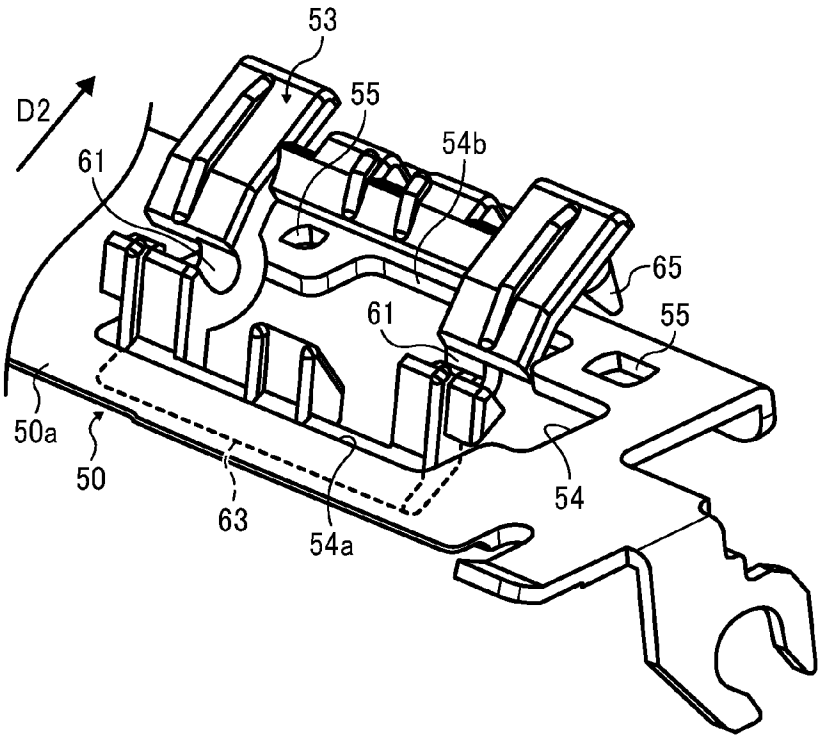
FIG. 16B is a perspective view of the holder and the separation plate depicted in FIG. 16A illustrating the first state in which the holder is being attached to the separation plate.
Figure 16A:
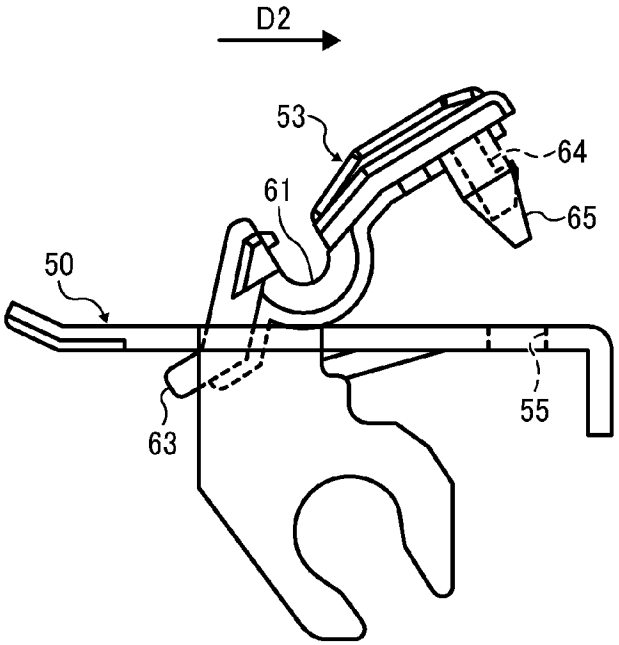
FIG. 16A is a side view of the holder and the separation plate of the separator depicted in FIG. 12 illustrating a first state in which the holder is being attached to the separation plate.

FIG. 16A is a side view of the holder 53 and the separation plate 50 illustrating a first state in which the holder 53 is being attached to the separation plate 50. FIG. 16B is a perspective view of the holder 53 and the separation plate 50 illustrating the first state in which the holder 53 is being attached to the separation plate 50. As illustrated in FIG. 16B, in order to attach the holder 53 to the separation plate 50, the upstream engagement 63 of the holder 53 is inserted into the primary through-hole 54 from the conveyance path side face 50*a* of the separation plate 50. For example, the upstream engagement 63 is brought into contact with the upstream edge 54*a* of the primary through-hole 54.

Figure 17B:
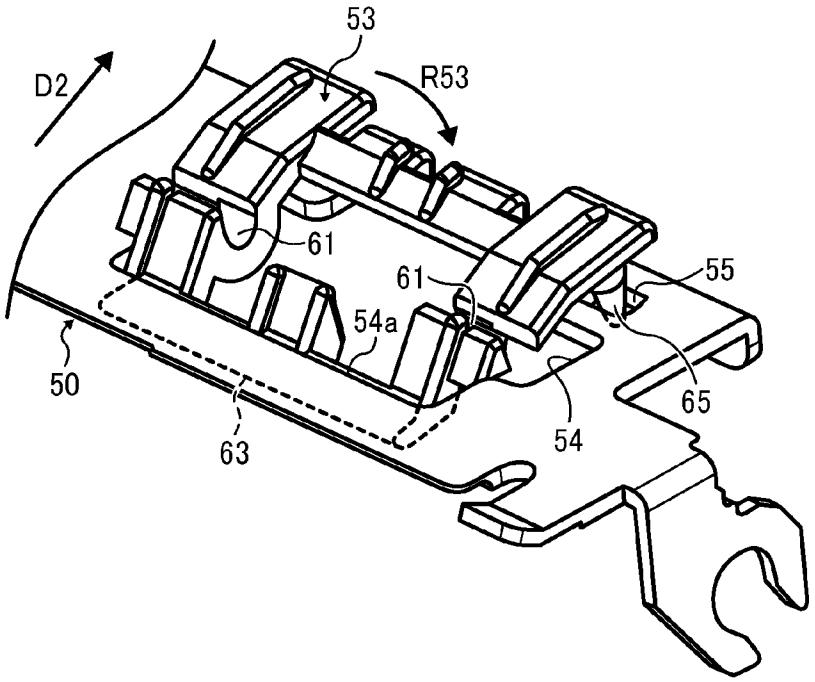
FIG. 17B is a perspective view of the holder and the separation plate depicted in FIG. 16B illustrating the second state in which the holder is being attached to the separation plate.
Figure 17A:
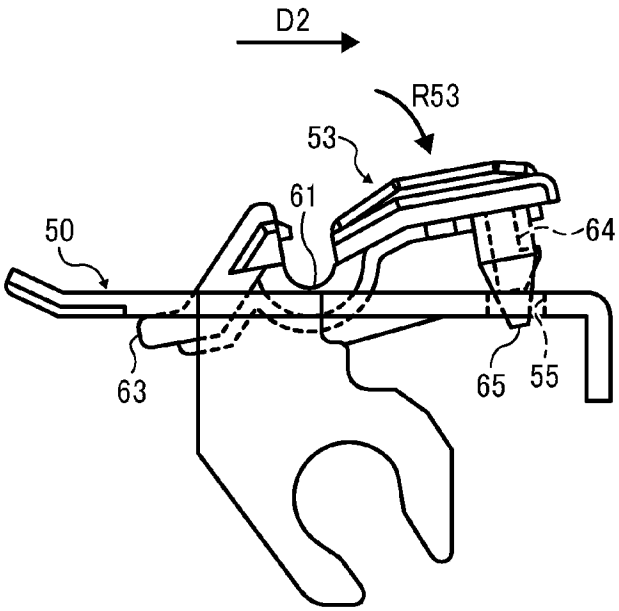
FIG. 17A is a side view of the holder and the separation plate depicted in FIG. 16A illustrating a second state in which the holder is being attached to the separation plate.

FIG. 17A is a side view of the holder 53 and the separation plate 50 illustrating a second state in which the holder 53 is being attached to the separation plate 50. FIG. 17B is a perspective view of the holder 53 and the separation plate 50 illustrating the second state in which the holder 53 is being attached to the separation plate 50. As illustrated in FIG. 17B, while the upstream engagement 63 contacts the upstream edge 54*a* of the primary through-hole 54, the holder 53 is rotated about a contact part where the upstream engagement 63 contacts the upstream edge 54*a* of the primary through-hole 54 in a rotation direction R53. Accordingly, the pair of projections 65 of the holder 53 is inserted into the pair of secondary through-holes 55 of the separation plate 50, respectively, positioning the holder 53 with respect to the separation plate 50.

Figure 18B:
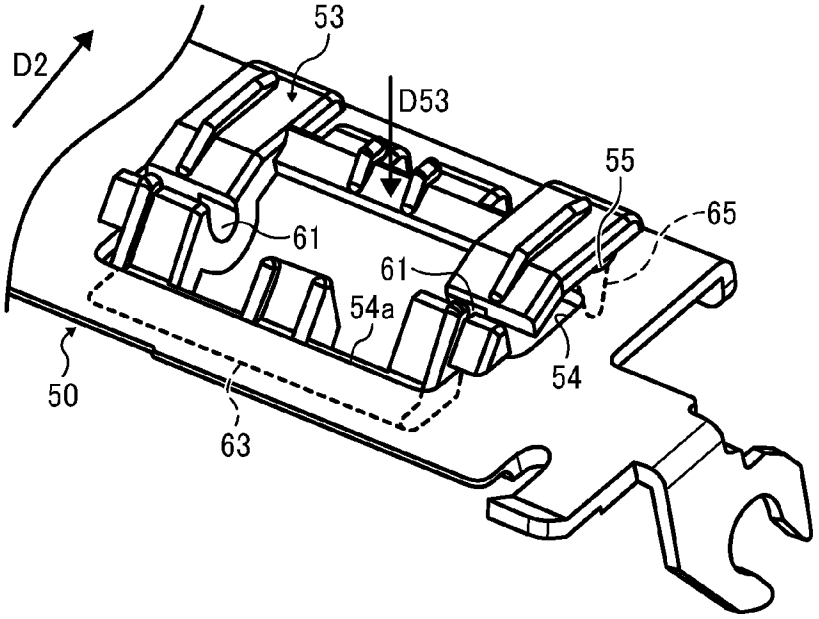
FIG. 18B is a perspective view of the holder and the separation plate depicted in FIG. 17B illustrating the third state in which the holder has been attached to the separation plate.
Figure 18A:
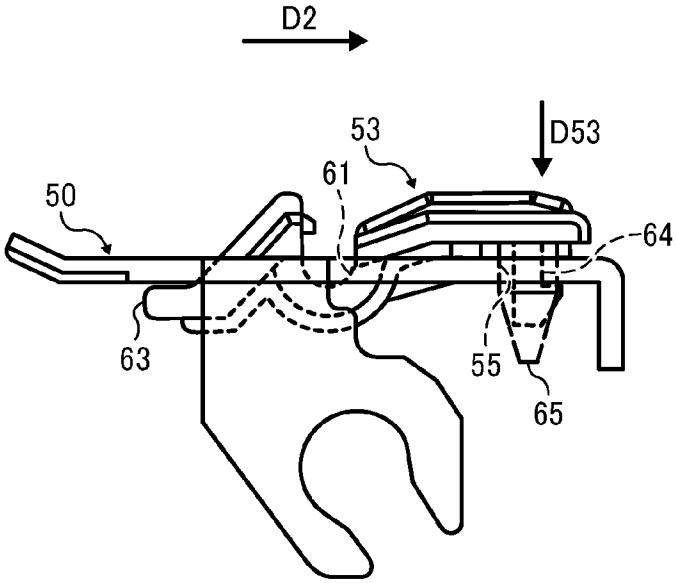
FIG. 18A is a side view of the holder and the separation plate depicted in FIG. 17A illustrating a third state in which the holder has been attached to the separation plate.

FIG. 18A is a side view of the holder 53 and the separation plate 50 illustrating a third state in which the holder 53 has been attached to the separation plate 50. FIG. 18B is a perspective view of the holder 53 and the separation plate 50 illustrating the third state in which the holder 53 has been attached to the separation plate 50. As illustrated in FIGS. 18A and 18B, a downstream section of the holder 53 in the sheet conveyance direction D2 is pressed against the separation plate 50 in a direction D53. Accordingly, the downstream engagement 64 of the holder 53 is elastically deformed while the downstream engagement 64 contacts the downstream edge 54*b* of the primary through-hole 54. When the downstream engagement 64 surmounts the downstream edge 54*b*, the downstream engagement 64 elastically recovers its original shape, engaging the secondary through-hole 55. Simultaneously, the upstream engagement 63 situated opposite the downstream engagement 64 in the sheet conveyance direction D2 engages the upstream edge 54*a* of the primary through-hole 54. Accordingly, the upstream engagement 63 and the downstream engagement 64 engage the holder 53 with the separation plate 50 to prevent the holder 53 from being uncoupled with the separation plate 50. Thus, attachment of the holder 53 to the separation plate 50 is completed.

Figure 19:
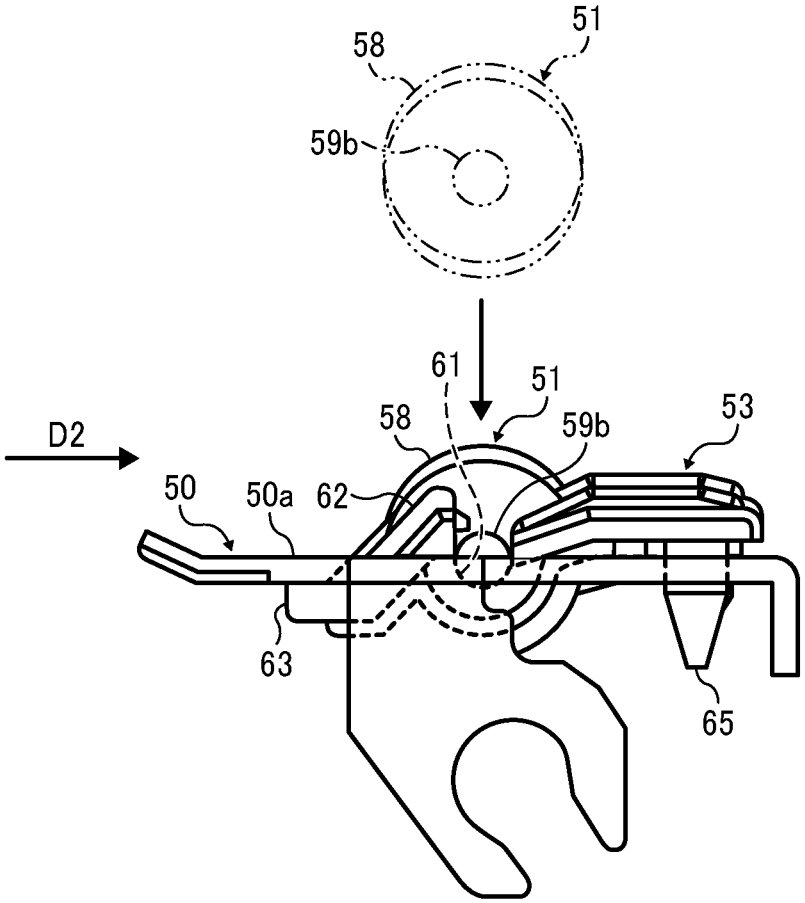
FIG. 19 is a side view of the holder, the separation plate, and the separation roller of the separator depicted in FIG. 12.

FIG. 19 is a side view of the holder 53, the separation plate 50, and the separation roller 51. As illustrated in FIG. 19, as the lateral end shaft portion 59*b* of the separation roller 51 is fitted into the bearing 61 of the holder 53, the separation roller 51 is attached to the separation plate 50 through the holder 53. In a state in which the separation roller 51 is attached to the separation plate 50, a rotation axis of the lateral end shaft portion 59*b* is substantially leveled with the conveyance path side face 50*a* of the separation plate 50 to define a substantially identical plane. The roller 58 of the separation roller 51 projects beyond the conveyance path side face 50*a* of the separation plate 50 toward the conveyance path CP. Further, the roller 58 of the separation roller 51 projects beyond the guide face 62 of the holder 53 toward the conveyance path CP. Thus, the guide face 62 and the roller 58 project beyond the conveyance path side face 50*a* of the separation plate 50 stepwise or continuously in the sheet conveyance direction D2, guiding the sheet P smoothly while preventing the sheet P from being caught in the roller 58.

In the above-described method for attaching the holder 53 to the separation plate 50, after the holder 53 is attached to the separation plate 50, the separation roller 51 is attached to the holder 53. Alternatively, after the separation roller 51 is attached to the holder 53, the holder 53 may be attached to the separation plate 50.

A description is provided of variations of the separator 29.

Figure 20:
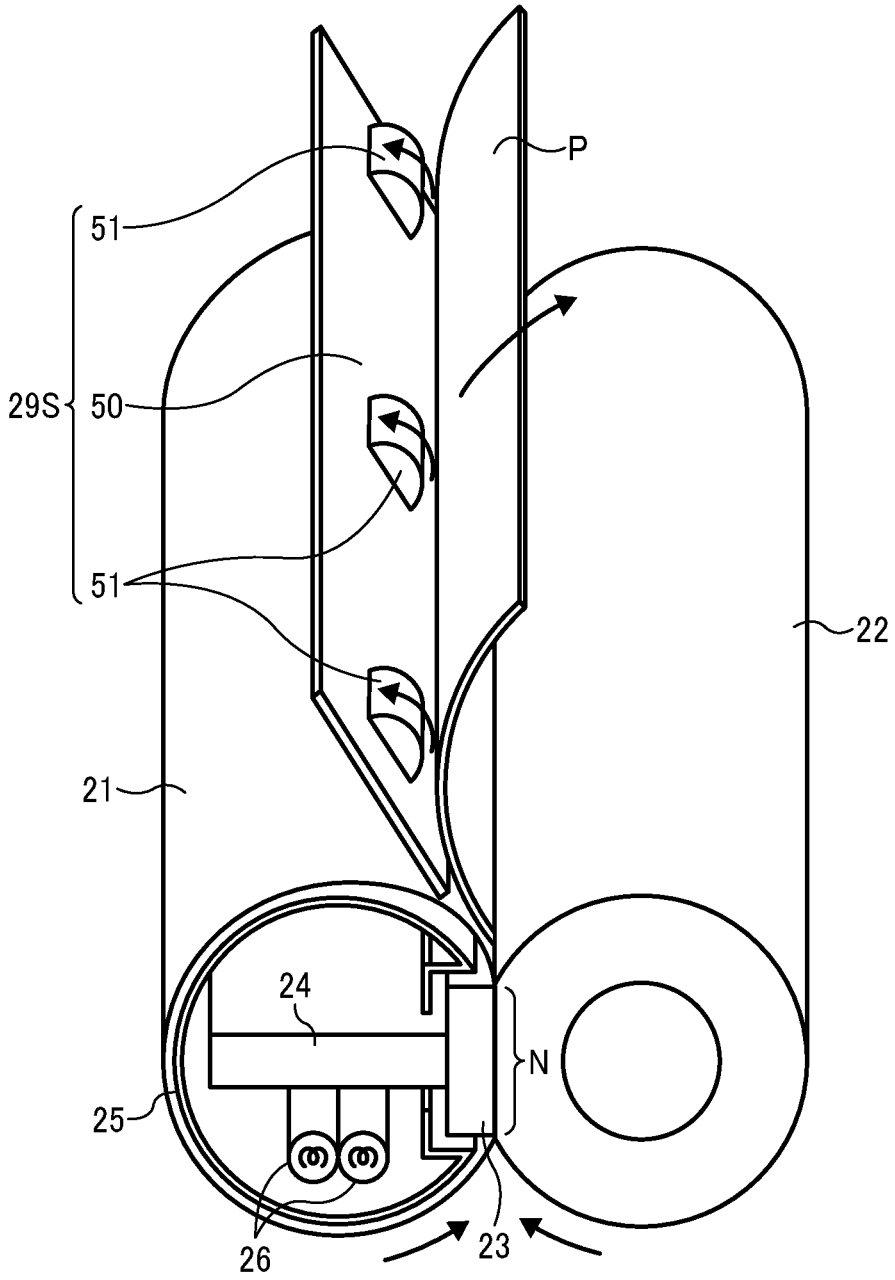
FIG. 20 is a perspective view of a separator as a first variation of the separator depicted in FIG. 10B.

FIG. 20 is a perspective view of a separator 29S as a first variation of the separator 29. The following describes a configuration of variations of the separator 29 that is different from the configuration of the separator 29 described above and a description of a configuration of variations of the separator 29 that is identical to the configuration of the separator 29 is omitted.

The separator 29 depicted in FIG. 8 includes the separation rollers 51 disposed at both lateral ends of the separation plate 50 in the longitudinal direction thereof, respectively. Alternatively, the separation rollers 51 may be situated at other positions. For example, as illustrated in FIG. 20, in addition to the separation rollers 51 disposed at both lateral ends of the separation plate 50 in the longitudinal direction thereof, respectively, the separation roller 51 may be situated at a center of the separation plate 50 in the longitudinal direction thereof. In this case, the center separation roller 51 facilitates separation of the sheet P from the fixing belt 21 at a center span of the fixing belt 21 in the axial direction thereof.

Figure 21:
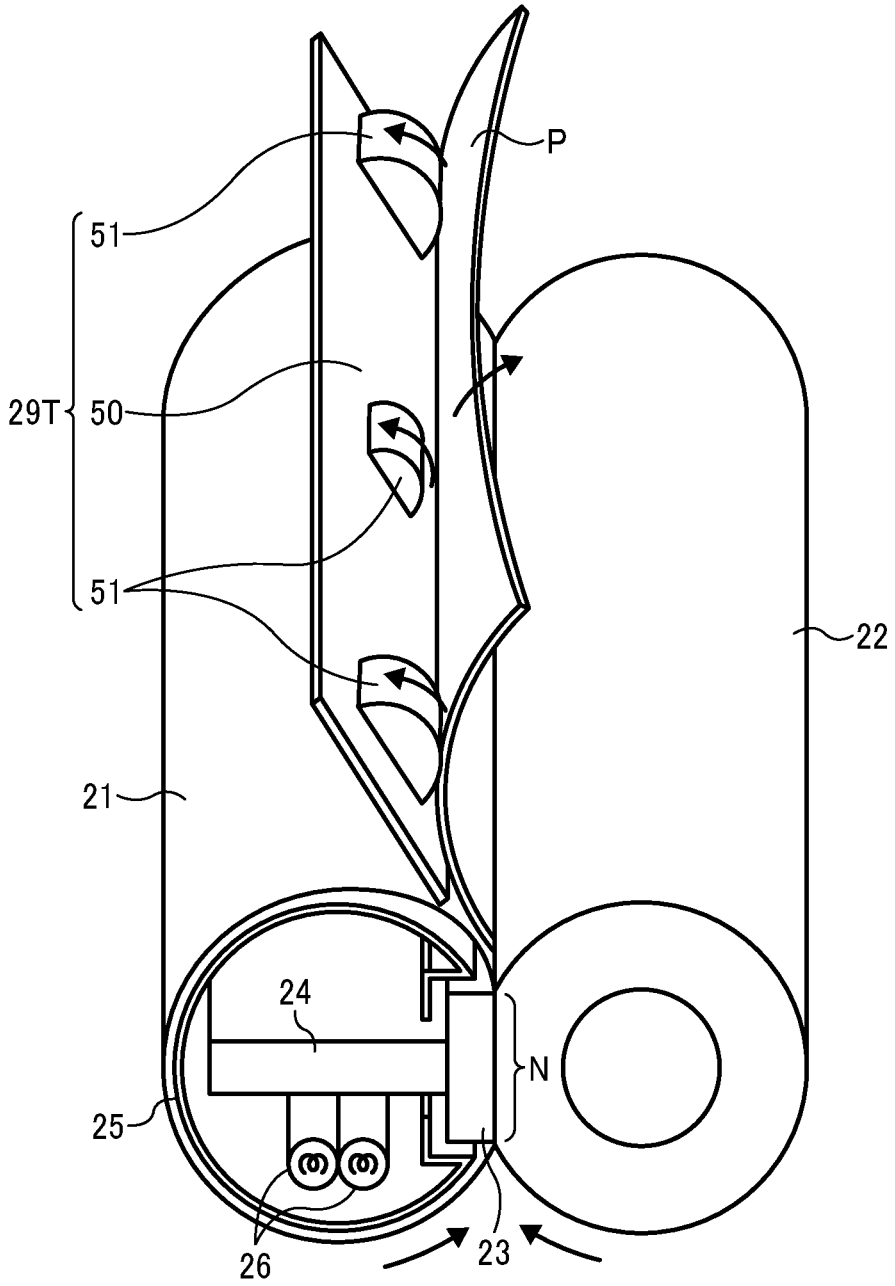
FIG. 21 is a perspective view of a separator as a second variation of the separator depicted in FIG. 10B.

FIG. 21 is a perspective view of a separator 29T as a second variation of the separator 29. The separator 29S depicted in FIG. 20 includes the center separation roller 51 and the lateral end separation rollers 51 that project toward the conveyance path CP in an identical amount. Conversely, the separator 29T depicted in FIG. 21 includes the lateral end separation rollers 51 that project toward the conveyance path CP in a projection amount greater than a projection amount of the center separation roller 51. In other words, among the three separation rollers 51 of the separator 29T situated at the center and both lateral ends of the separation plate 50 in the longitudinal direction thereof, the lateral end separation rollers 51 situated at both lateral ends of the separation plate 50 in the longitudinal direction thereof, respectively, project most toward the conveyance path CP. Accordingly, the separator 29T facilitates separation of the sheet P from the fixing belt 21 at the center of the separation plate 50 in the longitudinal direction thereof and bends the sheet P throughout the entire span of the sheet P in the axial direction of the fixing belt 21 while the sheet P is conveyed over the separator 29T, preventing the sheet P from tilting toward the fixing belt 21.

A description is provided of a construction of a separation roller 51S as a variation of the separation roller 51.

Figure 22:
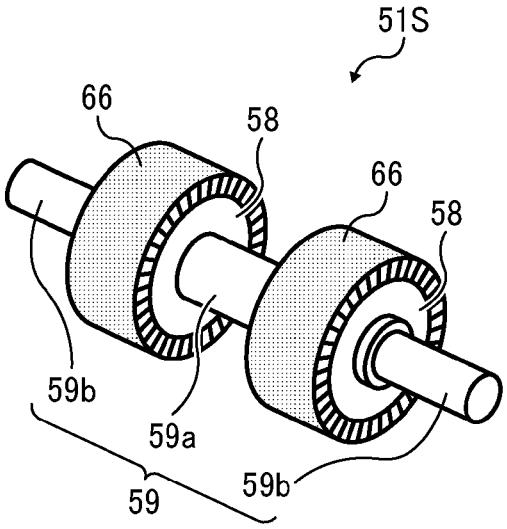
FIG. 22 is a perspective view of a separation roller as a variation of the separation roller depicted in FIG. 14.

FIG. 22 is a perspective view of the separation roller 51S. As illustrated in FIG. 22, the separation roller MS includes a plurality of fibers 66 (e.g., lots of fibers) mounted on a surface (e.g., an outer circumferential surface) of the roller 58. According to this exemplary embodiment, a sheet mounted with the heat resistant fibers 66 made of nylon, aramid, polyurethane, or the like in advance is adhered to the surface of the roller 58. Since the fibers 66 are mounted on the surface of the roller 58, even if the sheet P comes into contact with the separation roller 51S, the fibers 66 reduce adhesion of toner of the toner image T on the sheet P to the separation roller 51S and prevent the separation roller 51S from scratching the toner image T on the sheet P and producing gloss streaks on the toner image T on the sheet P. Even if the separation roller 51S is adhered with moisture from the sheet P, the fibers 66 absorb moisture, suppressing water droplets adhered to and marked on the sheet P and the toner image T on the sheet P. Since moisture absorbed in the fibers 66 evaporates as the entire fixing device 20 is warmed, the fibers 66 absorb moisture repeatedly. In order to absorb moisture effectively, the fibers 66 have a length not smaller than 0.8 mm, a fiber density not smaller than 10,000 pieces per square centimeter, and a fiber diameter not greater than 1.5 deniers.

The fibers 66 may be mounted on the surface of the roller 58 electrostatically. For example, the surface of the roller 58 is applied with an adhesive in advance. The roller 58 is electrostatically charged in a state in which multiple fibers 66 are mounted on the adhesive on the roller 58. An electrostatic force causes the fibers 66 to repulse each other and stand perpendicularly to the surface of the roller 58 until the adhesive is solidified. Unlike the fibers 66 mounted on the sheet and adhered to the roller 58, which produce a seam that may peel the sheet off the roller 58, the fibers 66 electrostatically mounted on the roller 58 do not produce the seam, enhancing durability of the separation roller 51S. Since the sheet mounting the fibers 66 is susceptible to dimensional variation and adhesion error, the sheet is not adhered to the roller 58 throughout the entire circumferential span of the roller 58. Accordingly, the sheet is adhered to the roller 58 in a decreased circumferential span of the roller 58 based on dimensional variation and adhesion error of the sheet. Conversely, the fibers 66 electrostatically mounted on the roller 58 span the entire circumferential span of the roller 58. Accordingly, the electrostatically mounted fibers 66 contact the sheet P in an increased area compared to the fibers 66 mounted on the sheet under the roller 58 having an identical dimension. Thus, the fibers 66 electrostatically mounted on the roller 58 suppress scratches and gloss streaks on the toner image T on the sheet P precisely.

The present disclosure is not limited to the details of the exemplary embodiments described above and various modifications and improvements are possible. For example, according to the exemplary embodiments described above, the separation plate 50 extending continuously throughout the entire width of the fixing belt 21 in the axial direction thereof serves as a separation body of the respective separators 29, 29S, and 29T. Alternatively, the separators 29, 29S, and 29T may employ a wedge-shaped separation claw having a decreased width in the axial direction of the fixing belt 21 as a separation body of the respective separators 29, 29S, and 29T. According to the exemplary embodiments described above, the separation roller 51 is used as a rotary separation aid. Alternatively, instead a roller (e.g., the roller 58 of the respective separation rollers 51 and 51S), a sphere or a ball may be used as a rotary separation aid.

Figure 23:
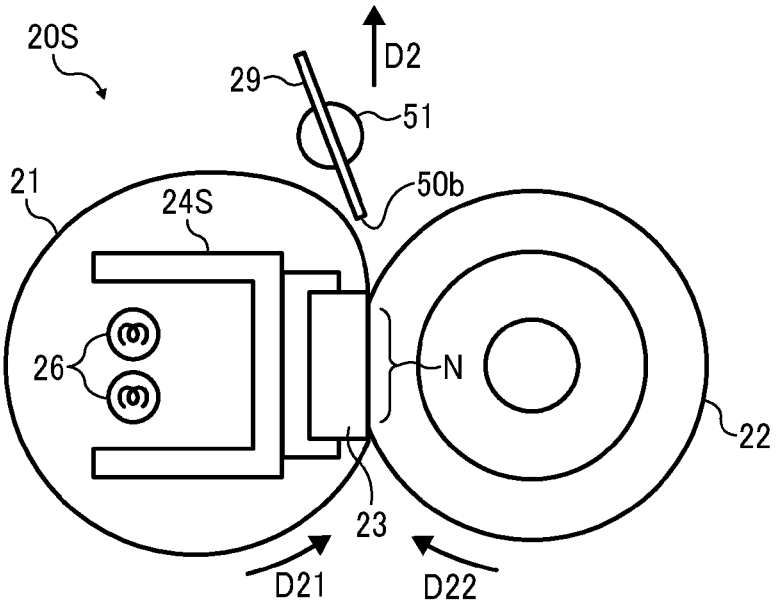
FIG. 23 is a schematic vertical cross-sectional view of a fixing device according to another exemplary embodiment of the present disclosure.

The separators 29, 29S, and 29T may be installed in fixing devices other than the fixing device 20 incorporating the tubular thermal conductor 25 disposed opposite the inner circumferential surface of the fixing belt 21 as illustrated in FIG. 2. For example, the separators 29, 29S, and 29T may be installed in a fixing device 20S not incorporating the thermal conductor 25 as illustrated in FIG. 23. FIG. 23 is a schematic vertical cross-sectional view of the fixing device 20S.

As illustrated in FIG. 23, the fixing device 20S includes the fixing belt 21 and the pressure roller 22 contacting the outer circumferential surface of the fixing belt 21. The fixing device 20S further includes the nip formation pad 23, a support 24S, and the heater 26. The nip formation pad 23 presses against the pressure roller 22 via the fixing belt 21 to form the fixing nip N between the fixing belt 21 and the pressure roller 22. At the fixing nip N, the nip formation pad 23 contacts the inner circumferential surface of the fixing belt 21. The support 24S supports the nip formation pad 23. The heater 26 heats the fixing belt 21.

Figure 24:
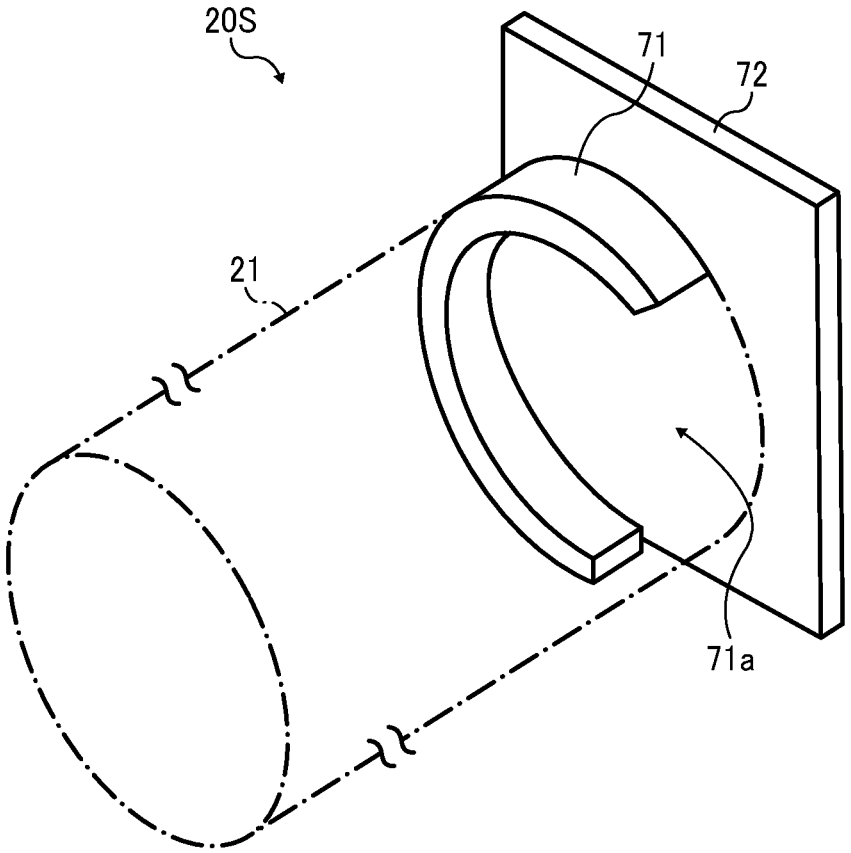
FIG. 24 is a partial perspective view of the fixing device depicted in FIG. 23.

FIG. 24 is a partial perspective view of the fixing device 20S. As illustrated in FIG. 24, a tubular or cylindrical, belt holder 71 (e.g., a flange) contacts each lateral end of the fixing belt 21 in the axial direction thereof to rotatably support the fixing belt 21. The belt holder 71 projects from a side plate 72 in the axial direction of the fixing belt 21. The belt holder 71 includes a slit 71*a* disposed opposite the fixing nip N to place the nip formation pad 23 at a predetermined position. Although FIG. 24 illustrates the belt holder 71 and the side plate 72 situated at one lateral end of the fixing belt 21 in the axial direction thereof, the belt holder 71 and the side plate 72 are also situated at another lateral end of the fixing belt 21 in the axial direction thereof.

Like the fixing device 20 depicted in FIG. 2, the fixing device 20S depicted in FIG. 23 includes the fixing belt 21 rotatable about the single axis. Unlike the fixing belt 21 of the fixing device 20 depicted in FIG. 2, in an axial span of the fixing belt 21 other than each lateral end of the fixing belt 21 in the axial direction thereof, the fixing belt 21 depicted in FIG. 23 is not guided by the thermal conductor 25 and is guided by the nip formation pad 23.

Unlike the fixing device 20 depicted in FIG. 2, the fixing device 20S does not incorporate the thermal conductor 25 disposed opposite the inner circumferential surface of the fixing belt 21. Hence, the heater 26 heats the fixing belt 21 directly with radiant heat. Accordingly, the fixing device 20S further shortens a warm-up time taken to heat the fixing belt 21 to a predetermined fixing temperature appropriate for fixing the toner image T on the sheet P from an ambient temperature after the image forming apparatus 1 is powered on and a first print time taken to output the sheet P bearing the fixed toner image T upon receipt of a print job through preparation for a print operation and the subsequent print operation.

Even if the separator 29, 29S, or 29T is installed in the fixing device 20S incorporating the fixing belt 21 rotatable about the single axis and heated directly by the heater 26, while the fixing belt 21 rotates in the rotation direction D21 compared to while the fixing belt 21 halts, the fixing belt 21 deforms and bulges radially outward at a position disposed downstream from the fixing nip N in the sheet conveyance direction D2. To address this circumstance, like the separator 29 installed in the fixing device 20, the separator 29 of the fixing device 20S is situated with respect to the fixing belt 21 such that the front end 50*b* of the separator 29 is isolated from the exit of the fixing nip N with an increased interval therebetween. However, the sheet P may receive heat from the fixing belt 21 excessively. Since the fixing belt 21 is rotatably supported by the belt holder 71 such that the fixing belt 21 is looped over no component as illustrated in FIG. 24, the fixing belt 21 is susceptible to deformation such that the fixing belt 21 bulges radially outward at the position in proximity to and downstream from the exit of the fixing nip N in the sheet conveyance direction D2. Accordingly, a rotary separation aid (e.g., the separation rollers 51 and 51S) of the separators 29, 29S, and 29T prevents the sheet P having passed through the fixing nip N from being conveyed while the sheet P is in contact with or in proximity to the fixing belt 21. Consequently, the sheet P does not receive heat from the fixing belt 21 excessively, preventing failures such as hot offset and decreased gloss of the toner image T on the sheet P.

A description is provided of advantages of the fixing devices 20 and 20S.

As illustrated in FIGS. 2 and 23, a fixing device (e.g., the fixing devices 20 and 20S) includes an endless fixing rotator (e.g., the fixing belt 21), a nip formation pad (e.g., the nip formation pad 23), and an opposed rotator (e.g., the pressure roller 22). The fixing rotator is rotatable in a predetermined direction of rotation (e.g., the rotation direction D21). The nip formation pad is disposed opposite an inner circumferential surface of the fixing rotator such that the fixing rotator slides over the nip formation pad. The opposed rotator contacts the fixing rotator to form the fixing nip N therebetween, through which a recording medium (e.g., a sheet P) bearing a toner image T is conveyed.

As illustrated in FIGS. 7, 20, and 21, the fixing device further includes a separator (e.g., the separators 29, 29S, and 29T) disposed opposite an outer circumferential surface of the fixing rotator to separate the recording medium ejected from the fixing nip N from the fixing rotator. The separator is isolated from the fixing rotator at least in a conveyance span of the fixing rotator in an axial direction thereof where an imaged region on the recording medium that bears the toner image T is conveyed over the fixing rotator. As illustrated in FIGS. 7 and 22, the separator includes a separation body (e.g., the separation plate 50) and a rotary separation aid (e.g., the separation rollers 51 and 51S). The separation body includes the front end 50*b* disposed in proximity to the outer circumferential surface of the fixing rotator and the conveyance path side face 50*a* that faces the conveyance path CP where the recording medium is conveyed. The rotary separation aid projects beyond the conveyance path side face 50*a* of the separation body toward the conveyance path CP where the recording medium is conveyed. As the recording medium ejected from the fixing nip N comes into contact with the rotary separation aid, the rotary separation aid is rotated by the recording medium.

Since the rotary separation aid mounted on the separation body projects toward the conveyance path CP, as the recording medium having passed through the fixing nip N comes into contact with the rotary separation aid, the rotary separation aid directs and conveys the recording medium in a direction in which the recording medium separates from the fixing rotator. Accordingly, the rotary separation aid prevents the recording medium having passed through the fixing nip N from being conveyed while the recording medium is in contact with or in proximity to the fixing rotator. Consequently, the recording medium is not overheated by the fixing rotator, preventing failures such as hot offset and decreased gloss of the toner image T on the recording medium.

According to the exemplary embodiments described above, the fixing belt 21 serves as a fixing rotator. Alternatively, a fixing film, a fixing sleeve, or the like may be used as a fixing rotator. Further, the pressure roller 22 serves as an opposed rotator. Alternatively, a pressure belt or the like may be used as an opposed rotator.

The present disclosure has been described above with reference to specific exemplary embodiments. Note that the present disclosure is not limited to the details of the embodiments described above, but various modifications and enhancements are possible without departing from the spirit and scope of the disclosure. It is therefore to be understood that the present disclosure may be practiced otherwise than as specifically described herein. For example, elements and/or features of different illustrative exemplary embodiments may be combined with each other and/or substituted for each other within the scope of the present disclosure.

What is claimed is:

1. A separator for separating a recording medium from a fixing rotator, the separator comprising:

a separation body including:

a front end disposed in proximity to an outer circumferential surface of the fixing rotator; and a conveyance path side face facing a conveyance path where the recording medium is conveyed; and rotary separation aids projecting beyond the conveyance path side face of the separation body toward the conveyance path, the rotary separation aids rotated by the recording medium as the recording medium comes into contact with the rotary separation aids, wherein the rotary separation aids include:

a first lateral end rotary separation aid disposed at one lateral end of the separation body in an intersecting direction intersecting a recording medium conveyance direction;

a second lateral end rotary separation aid disposed at another lateral end of the separation body in the intersecting direction; and a center rotary separation aid disposed at a center of the separation body in the intersecting direction, wherein an amount of projection of each of the first lateral end rotary separation aid and the second lateral end rotary separation aid is greater than an amount of projection of the center rotary separation aid.

2. The separator according to claim 1, wherein the separator is isolated from the outer circumferential surface of the fixing rotator at least in a conveyance span of the fixing rotator in an axial direction of the fixing rotator where an imaged region on the recording medium that bears a toner image is conveyed over the fixing rotator.

3. The separator according to claim 1, further comprising a plurality of fibers mounted on a surface of the rotary separation aid.

4. The separator according to claim 3, wherein the plurality of fibers is mounted on the rotary separation aid electrostatically.

5. The separator according to claim 3, wherein the plurality of fibers has a length not smaller than 0.8 mm.

6. The separator according to claim 3, wherein the plurality of fibers has a density not smaller than 10,000 pieces per square centimeter.

7. The separator according to claim 3, wherein the plurality of fibers is made of nylon.

8. The separator according to claim 1, further comprising a holder to rotatably hold the rotary separation aids, wherein the separation body includes a through-hole into which the holder is inserted.

9. The separator according to claim 8, wherein the holder includes a guide face, disposed upstream from the rotary separation aids in the recording medium conveyance direction, to guide the recording medium to the rotary separation aids.

10. The separator according to claim 1, wherein the separation body includes a plate.

11. A fixing device comprising:

a fixing rotator rotatable in a predetermined direction of rotation;

an opposed rotator to press against the fixing rotator to form a fixing nip between the fixing rotator and the opposed rotator, the fixing nip through which a recording medium bearing a toner image is conveyed;

a heater to heat the fixing rotator; and a separator, disposed downstream from the fixing rotator in a recording medium conveyance direction, to separate the recording medium from the fixing rotator, the separator including:

a separation body including:

a front end disposed in proximity to an outer circumferential surface of the fixing rotator; and a conveyance path side face facing a conveyance path where the recording medium is conveyed; and rotary separation aids projecting beyond the conveyance path side face of the separation body toward the conveyance path, the rotary separation aids rotated by the recording medium as the recording medium comes into contact with the rotary separation aids, wherein the rotary separation aids include:

a first lateral end rotary separation aid disposed at one lateral end of the separation body in an intersecting direction intersecting a recording medium conveyance direction;

a second lateral end rotary separation aid disposed at another lateral end of the separation body in the intersecting direction; and a center rotary separation aid disposed at a center of the separation body in the intersecting direction, wherein an amount of projection of each of the first lateral end rotary separation aid and the second lateral end rotary separation aid is greater than an amount of projection of the center rotary separation aid.

12. The fixing device according to claim 11, wherein a downstream end of the fixing nip in the recording medium conveyance direction and a projection summit of the rotary separation aids projecting toward the conveyance path define a hypothetical line that does not overlap a trajectory of the fixing rotator at a position downstream from the fixing nip in the recording medium conveyance direction.

13. The fixing device according to claim 11, wherein the fixing rotator includes a flexible endless belt to rotate about a single axis.

14. The fixing device according to claim 13, further comprising a belt holder rotatably supporting the endless belt at each lateral end of the endless belt in an axial direction of the endless belt such that the endless belt is looped over no component.

15. The fixing device according to claim 13, wherein while the endless belt rotates, the endless belt bulges radially outward at a position disposed downstream from the fixing nip in the recording medium conveyance direction compared to while the endless belt halts.

16. The fixing device according to claim 13, further comprising a nip formation pad including a planar contact face contacting an inner circumferential surface of the endless belt and being disposed opposite the opposed rotator via the endless belt, the contact face over which the endless belt slides.

17. An image forming apparatus comprising:

an image forming device to form a toner image; and a fixing device, disposed downstream from the image forming device in a recording medium conveyance direction, to fix the toner image on a recording medium, the fixing device including:

a fixing rotator rotatable in a predetermined direction of rotation;

an opposed rotator to press against the fixing rotator to form a fixing nip between the fixing rotator and the opposed rotator, the fixing nip through which the recording medium bearing the toner image is conveyed;

a heater to heat the fixing rotator; and a separator, disposed downstream from the fixing rotator in the recording medium conveyance direction, to separate the recording medium from the fixing rotator, the separator including:

a separation body including:

a front end disposed in proximity to an outer circumferential surface of the fixing rotator; and a conveyance path side face facing a conveyance path where the recording medium is conveyed; and rotary separation aids projecting beyond the conveyance path side face of the separation body toward the conveyance path, the rotary separation aids rotated by the recording medium as the recording medium comes into contact with the rotary separation aids, wherein the rotary separation aids include:

a first lateral end rotary separation aid disposed at one lateral end of the separation body in an intersecting direction intersecting a recording medium conveyance direction;

a second lateral end rotary separation aid disposed at another lateral end of the separation body in the intersecting direction; and a center rotary separation aid disposed at a center of the separation body in the intersecting direction, wherein an amount of projection of each of the first lateral end rotary separation aid and the second lateral end rotary separation aid is greater than an amount of projection of the center rotary separation aid.

* * * * *